US006506275B1

(12) United States Patent
Vijuk et al.

(10) Patent No.: US 6,506,275 B1
(45) Date of Patent: Jan. 14, 2003

(54) INFORMATIONAL ITEM FORMING AND BONDING MACHINE AND METHOD

(75) Inventors: Joseph M. Vijuk, Oakbrook, IL (US); William C. Neubauer, Grayslake, IL (US); Ilija Ilijevski, Schererville, IN (US)

(73) Assignee: Vijuk Equipment, Inc., Elmhurst, IL (US)

( * ) Notice: Subject to any disclaimer, the term of this patent is extended or adjusted under 35 U.S.C. 154(b) by 0 days.

(21) Appl. No.: 09/579,911

(22) Filed: May 26, 2000

(51) Int. Cl.[7] ..... B41L 43/10
(52) U.S. Cl. ..... 156/227; 283/81
(58) Field of Search ..... 156/226, 227, 156/443; 283/81

(56) References Cited

U.S. PATENT DOCUMENTS

| | | | | |
|---|---|---|---|---|
| 1,239,965 | A | 9/1917 | Reinhold | |
| 1,273,105 | A | 7/1918 | Van Dyke et al. | |
| 1,326,859 | A | 12/1919 | Grammar | |
| 1,853,829 | A | 4/1932 | Maury | 283/34 |
| 1,974,401 | A | 9/1934 | Miller | 40/4 |
| 2,706,865 | A | 4/1955 | Miller | 40/2 |
| 2,751,222 | A | 6/1956 | Dexter | 270/81 |
| 2,862,624 | A | 12/1958 | Stokes | 281/21.1 X |
| 3,760,520 | A | 9/1973 | Hamilton | 40/102 |
| 3,773,314 | A | 11/1973 | Giovannini | 270/63 |
| 3,994,118 | A | 11/1976 | Felix | 53/124 D |
| 4,010,299 | A | 3/1977 | Hershey, Jr. et al. | 40/310 X |
| 4,097,067 | A | 6/1978 | Schechter | 283/62 X |
| 4,229,926 | A | 10/1980 | Rowling | 53/429 |
| 4,270,742 | A | 6/1981 | Kobayashi | 270/37 |
| 4,331,327 | A | 5/1982 | Felix | 271/9 |
| RE30,958 | E | 6/1982 | White | 40/310 |
| 4,441,739 | A | 4/1984 | Cluff et al. | 281/16 |
| 4,529,229 | A | 7/1985 | Glibbery | 283/81 |
| 4,583,763 | A | 4/1986 | Shacklett, Jr. | 281/2 X |
| 4,606,553 | A | 8/1986 | Nickerson | 281/5 |
| 4,616,815 | A | 10/1986 | Vijuk | 270/45 |
| 4,621,837 | A | 11/1986 | Mack | 283/105 |
| 4,637,633 | A | 1/1987 | Instance | 283/81 |
| 4,660,856 | A | 4/1987 | Shacklett, Jr. | 281/5 |
| 4,685,993 | A | 8/1987 | Flaherty et al. | 156/475 |
| 4,708,368 | A | 11/1987 | Instance | 283/81 |
| 4,812,195 | A | 3/1989 | Vijuk | 156/357 |
| 4,817,931 | A | 4/1989 | Vijuk | 270/18 |
| 4,830,406 | A | 5/1989 | Instance | 283/81 |
| 4,850,611 | A | 7/1989 | Skelton | 251/5 |
| 4,853,063 | A | 8/1989 | Basgil et al. | 156/238 |
| 4,868,027 | A | 9/1989 | Hunkeler et al. | 428/42 |
| 4,887,373 | A | 12/1989 | Macaulay | 40/119 |
| 4,905,977 | A | 3/1990 | Vijuk | 270/45 |

(List continued on next page.)

FOREIGN PATENT DOCUMENTS

| | | | |
|---|---|---|---|
| DE | 10939 | 9/1880 | 281/5 |
| FR | 744196 | 4/1933 | 281/5 |
| FR | 1403865 | 5/1965 | 281/5 |
| GB | 28013 | 12/1907 | 283/34 |
| GB | 20385 | 10/1914 | 283/34 |

*Primary Examiner*—Michael W. Ball
*Assistant Examiner*—Barbara J Musser
(74) *Attorney, Agent, or Firm*—Marshall, Gerstein & Borun

(57) ABSTRACT

A method and machine for forming and bonding informational items together be provided with a first folding unit that forms a plurality of first folded articles from a plurality of sheets of paper having printed information thereon, the first folding unit having a plurality of cylindrical folding rollers and forming each of the first folded articles by making a plurality of folds in one of the sheets of paper, a second folding unit that forms a plurality of informational items from the first folded articles received from the first folding unit, and a bonding unit operatively coupled to automatically receive informational items folded by the second folding unit that causes a plurality of the informational items to be bonded together into stacks of informational items.

19 Claims, 14 Drawing Sheets

U.S. PATENT DOCUMENTS

| | | | | |
|---|---|---|---|---|
| 4,906,024 | A | | 3/1990 | Lein ..... 283/34 X |
| 4,991,878 | A | | 2/1991 | Cowan et al. ..... 283/81 |
| 4,997,205 | A | | 3/1991 | Hansch ..... 281/2 |
| 5,044,873 | A | | 9/1991 | Vijuk ..... 414/712.5 |
| 5,046,710 | A | | 9/1991 | Vijuk ..... 270/37 |
| 5,074,595 | A | | 12/1991 | Hill et al. ..... 283/81 |
| 5,156,898 | A | | 10/1992 | McDonald ..... 428/130 X |
| 5,200,243 | A | | 4/1993 | Van Veen ..... 428/40 |
| 5,207,746 | A | | 5/1993 | Jones ..... 283/81 |
| 5,234,231 | A | | 8/1993 | Hollander et al. ..... 281/2 |
| 5,254,189 | A | | 10/1993 | Hirobe et al. ..... 156/64 |
| 5,351,991 | A | | 10/1994 | McDonald ..... 281/5 X |
| 5,403,636 | A | | 4/1995 | Crum ..... 428/40 |
| 5,439,721 | A | | 8/1995 | Pedroli et al. ..... 428/40 |
| 5,458,374 | A | | 10/1995 | Vijuk et al. ..... 281/2 X |
| 5,480,370 | A | | 1/1996 | Gelsinger ..... 493/475 |
| 5,593,749 | A | | 1/1997 | Instance ..... 428/40.1 |
| 5,599,410 | A | | 2/1997 | Reinders ..... 156/64 |
| 5,605,730 | A | | 2/1997 | Treleaven ..... 428/40.1 |
| 5,639,332 | A | | 6/1997 | Instance ..... 156/248 |
| 5,667,210 | A | | 9/1997 | DeLise, Jr. ..... 270/37 |
| 5,685,530 | A | | 11/1997 | DeLise ..... 270/37 |
| 5,791,689 | A | * | 8/1998 | Dovel ..... 281/5 |
| 5,813,700 | A | | 9/1998 | Vijuk et al. ..... 283/81 |
| 5,909,899 | A | | 6/1999 | Vijuk et al. ..... 283/81 |
| 6,068,300 | A | | 5/2000 | Vijuk et al. ..... 283/67 |

* cited by examiner

INFORMATIONAL ITEM FORMING AND BONDING MACHINE AND METHOD

BACKGROUND OF THE INVENTION

The present invention is directed to a method and machine for forming informational items, such as outserts, and bonding together the informational items in a stack.

An outsert is an informational item formed from a sheet of paper which is folded in two perpendicular directions. The sheet of paper has information printed thereon, which is typically information relating to a pharmaceutical product or drug. The outsert may be adhesively attached to the top or side of a pharmaceutical container, such as a bottle of pills. Alternatively, the outsert may be inserted loosely into a cardboard box in which a pharmaceutical container is disposed. After purchase of the pharmaceutical product by a consumer, the outsert may be unfolded so that the consumer may read the information printed thereon.

There are a number of patents which disclose methods of forming outserts and machines that may be used in connection with the formation of outserts. For example, U.S. Pat. No. 4,616,815 to Michael Vijuk discloses an automatic stacking and folding apparatus. U.S. Pat. No. 4,812,195 to Michael Vijuk discloses various methods and apparatus for forming outserts. U.S. Pat. No. 4,817,931 to Robert Vijuk discloses a method and apparatus for forming a folded leaflet. U.S. Pat. No. 5,044,873 to Michael Vijuk discloses an apparatus for stacking folded sheets on edge. U.S. Pat. Nos. 5,458,374, 5,813,700 and 5,909,899 disclose various methods of forming outserts.

SUMMARY OF THE INVENTION

In one aspect, the invention is directed to a method of forming outserts having product information relating to a pharmaceutical product printed thereon and bonding said outserts together, comprising: (a) forming a first outsert from a first sheet of paper having information relating to a pharmaceutical product printed thereon by making at least one fold in a first direction in said first sheet of paper and by making at least one fold in a second direction that is perpendicular to said first direction, said first outsert having a first face and a second face opposite said first face; (b) forming a second outsert from a second sheet of paper having information relating to a pharmaceutical product printed thereon by making at least one fold in a first direction in said second sheet of paper and by making at least one fold in a second direction that is perpendicular to said first direction, said second outsert having a first face and a second face opposite said first face; (c) forming a third outsert from a third sheet of paper having information relating to a pharmaceutical product printed thereon by making at least one fold in a first direction in said third sheet of paper and by making at least one fold in a second direction that is perpendicular to said first direction, said third outsert having a first face and a second face opposite said first face; (d) automatically conveying said first, second and third outserts to a bonding apparatus; (e) automatically depositing an adhesive on one of said faces of said first outsert and one of said faces of said second outsert; and (f) causing said one of said faces of said first outsert to be bonded to one of said faces of said second outsert and one of said faces of said second outsert to be bonded to one of said faces of said third outsert to form a multiple outsert assembly having said second outsert adhesively bonded between said first outsert and said third outsert.

In another aspect, the invention is directed to a method of forming outserts having product information relating to a pharmaceutical product printed thereon and bonding said outserts together, comprising: (a) folding a first sheet of paper having information relating to a pharmaceutical product printed thereon by making a plurality of folds in said first sheet of paper to form a first folded article, said folds in said first sheet of paper being parallel to each other and parallel to a first direction; (b) folding said first folded article by making a plurality of folds in said first folded article to form a second folded article, said folds in said first folded article being parallel to a second direction, said second direction being perpendicular to said first direction; (c) depositing an adhesive on a portion of said second folded article; (d) folding said second folded article by making a fold in said second folded article to form a first outsert having a first face and a second face opposite said first face, said fold in said second folded article being parallel to said second direction and being made so that said adhesive holds said first outsert in a substantially closed position; (e) folding a second sheet of paper having information relating to a pharmaceutical product printed thereon by making a plurality of folds in said second sheet of paper to form a third folded article, said folds in said second sheet of paper being parallel to each other and parallel to said first direction; (f) folding said third folded article by making a plurality of folds in said third folded article to form a fourth folded article, said folds in said third folded article being parallel to said second direction; (g) depositing an adhesive on a portion of said fourth folded article; (h) folding said fourth folded article by making a fold in said fourth folded article to form a second outsert having a first face and a second face opposite said first face of said second outsert, said fold in said fourth folded article being parallel to said second direction and being made so that said adhesive holds said second outsert in a substantially closed position; (i) folding a third sheet of paper having information relating to a pharmaceutical product printed thereon by making a plurality of folds in said third sheet of paper to form a fifth folded article, said folds in said third sheet of paper being parallel to each other and parallel to said first direction; (j) folding said fifth folded article by making a plurality of folds in said fifth folded article to form a sixth folded article, said folds in said fifth folded article being parallel to said second direction; (k) depositing an adhesive on a portion of said sixth folded article; (1) folding said sixth folded article by making a fold in said sixth folded article to form a third outsert having a first face and a second face opposite said first face of said third outsert, said fold in said sixth folded article being parallel to said second direction and being made so that said adhesive holds said third outsert in a substantially closed position; (m) automatically conveying said first outsert to a bonding apparatus; (n) automatically conveying said second outsert to said bonding apparatus; (o) automatically conveying said third outsert to said bonding apparatus; (p) automatically depositing an adhesive on one of said faces of said first outsert; (q) automatically depositing an adhesive on one of said faces of said second outsert; (r) orienting said first outsert in a vertical orientation; (s) orienting said second outsert in a vertical orientation; (t) with said first and second outserts in said vertical orientations, pushing said second outsert against said first outsert so that said one face of said first outsert with said adhesive disposed thereon is forced against said one face of said second outsert to adhesively bond said first outsert to said second outsert; (u) orienting said third outsert in a vertical orientation; and (v) with said second and third outserts in said vertical orientations, pushing said third outsert against said second outsert so that said one face of said second outsert with said adhesive disposed thereon is forced against said one face of said third outsert to adhesively bond said second outsert to said third outsert.

Other aspects of the invention are defined by the claims set forth at the end of this patent.

DETAILED DESCRIPTION OF VARIOUS EMBODIMENTS

Figure 1:
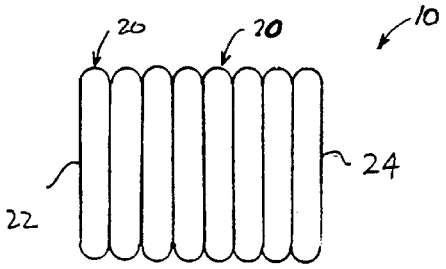
FIG. 1 is a side view of a stack of informational items bonded together.

FIG. 1 is a side view of a stack 10 of informational items 20 bonded together, such as by an adhesive. Referring to FIG. 1, each of the informational items 20 has a first face 22 and a second face 24 opposite the first face 22. Each of the informational items 20 has detailed information printed thereon, which printed information typically relates to one or more pharmaceutical products or drugs.

The informational items 20 may be bonded together via an adhesive disposed between adjacent faces 22, 24 of adjacent informational items 20. The informational items 20 may be bonded together via an adhesive that allows one of the informational items 20 to be manually removed from the stack 10 so that the removed informational item 20 can be inserted into a box or carton containing a pharmaceutical item or drug.

The adhesive, which may be a cold adhesive or a hot-melt adhesive, may be selected so as to allow easy removal of one of the informational items 20 from the stack without tearing or otherwise damaging the removed informational item 20 or the remaining informational items 20 of the stack 10. One adhesive that may be used is a cold glue adhesive, GMS Part No. GLUE-23704, which is commercially available from Graphic Machinery & Systems of San Rafael, Calif. That adhesive is also marketed by its manufacturer as Capitol Latex Adhesive L179.

Each of the informational items 20 can be provided in the form of an outsert, or each of the informational items 20 can be provided in the form of a booklet, which may be provided in unfolded form or folded form. As used herein, the term "outsert" generally means an informational item which is folded from a sheet of paper and which can be later unfolded to read information printed on the sheet of paper. As used herein, the term "booklet" generally means an informational item having a plurality of pages which are bonded or otherwise connected together along one edge. A booklet may be an unfolded booklet or a folded booklet, as described below.

Methods of Forming Outserts

Figure 2:
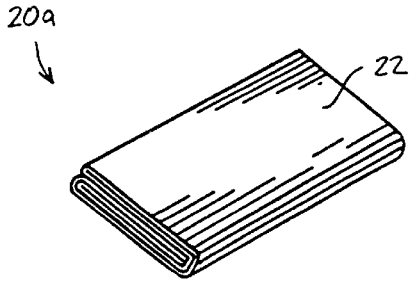
FIG. 2 is a perspective view of one embodiment of one of the informational items of FIG. 1.

FIG. 2 is a perspective view of an outsert 20*a* which may be included as part of the stack 10 of informational items 20, and FIGS. 2A–2E illustrate a method of forming the outsert 20*a*.

Figure 2A:
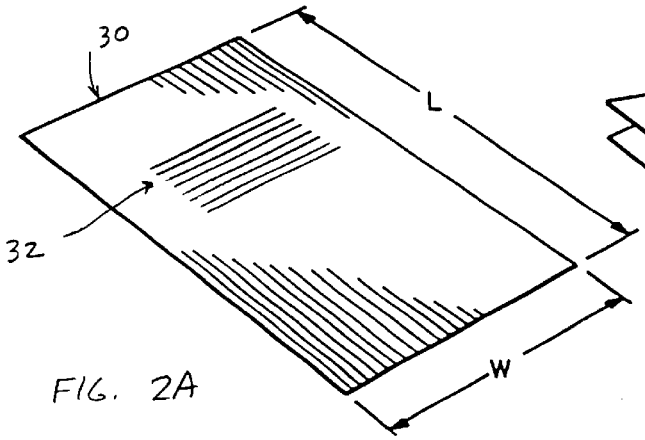
FIGS. 2A–2E illustrate the manner in which the informational item of FIG. 2 is formed.
Figure 2B:
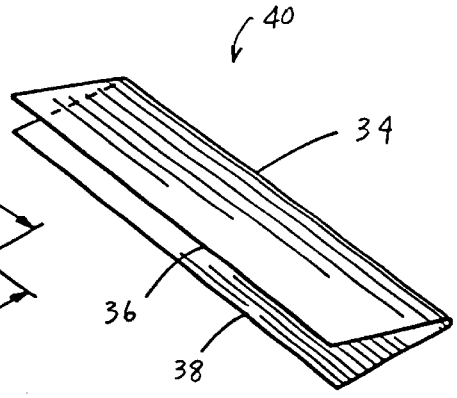

Referring to FIG. 2A, the outsert 20*a* may be formed from a sheet 30 of paper having information 32 printed thereon. The sheet 30 has a length L and a width W. Referring to FIG. 2B, the sheet 30 may be folded in a direction parallel to its length, such as by folding the sheet 30 in half, so that the sheet has a fold or folded edge 34 that is parallel to its length and a pair of unfolded edges 36, 38 parallel to its length. One or more additional folds (not shown) may be made in a direction parallel to the length of the sheet 30. As a result of making such fold(s) in the direction parallel to the length of the sheet 30, a folded article 40 having a length and a width is formed.

Figure 2C:
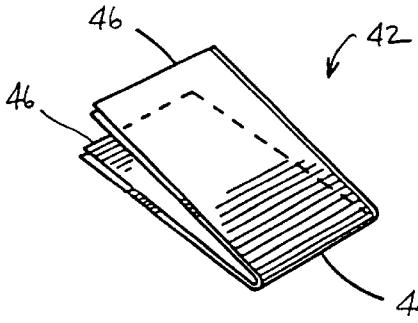

Referring to FIG. 2C, the folded article 40 shown in FIG. 2B is then folded in a direction parallel to the width of the folded article 40 and perpendicular to its length to form a folded article 42 having a first end that is composed of a fold or folded edge 44 and a second end composed of a plurality of unfolded sheet edges 46.

Figure 2D:
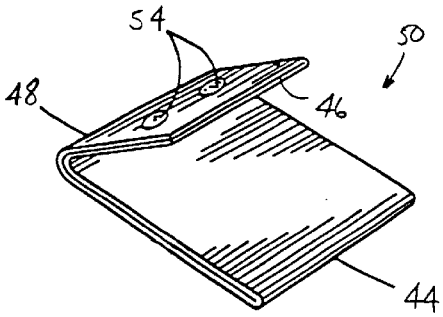

Referring to FIG. 2D, the folded article 42 shown in FIG. 2C is then folded again by making a fold 48 in the same direction as the fold 44 made in FIG. 2C to form a folded article 50. The folded article 50 has a first end that is composed of the folded edge 44 and a second end composed of the fold or folded edge 48. The fold 48 of FIG. 2D is made so that the unfolded sheet edges 46 are disposed between the two folded edges 44, 48. One or more drops 54 of adhesive may be applied to a sheet portion of the folded article 50.

Figure 2E:
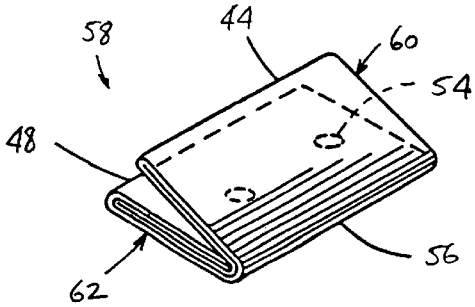

Referring to FIG. 2E, the folded article 50 shown in FIG. 2D is then folded again by making a fold 56 in the same direction to form a folded article 58, with the unfolded sheet edges 46 being enclosed within the folded article 58. The fold 56 may be made at a point along the folded article 50 so that the folded edges 44, 48 are disposed directly adjacent each other. The folded article 58 has an upper portion 60 composed of a plurality of sheet thicknesses and a lower portion 62 composed of a plurality of sheet thicknesses. When the upper portion 60 makes contact with the adhesive 54 disposed on the lower portion 62, the adhesive 54 bonds the upper and lower portions 60, 62 together to form the substantially closed outsert 20*a* shown in FIG. 2 having no exterior unfolded sheet edges that lie in a direction parallel to the fold 56.

Figure 3:
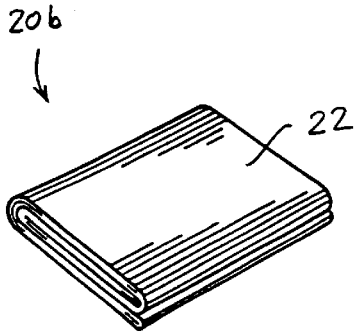
FIG. 3 is a perspective view of another embodiment of one of the informational items of FIG. 1.

FIG. 3 is a perspective view of an outsert 20*b* which may be included as part of the stack 10 of informational items 20, and FIGS. 3A–3I illustrate a method of forming the outsert 20*b*.

Figure 3A:
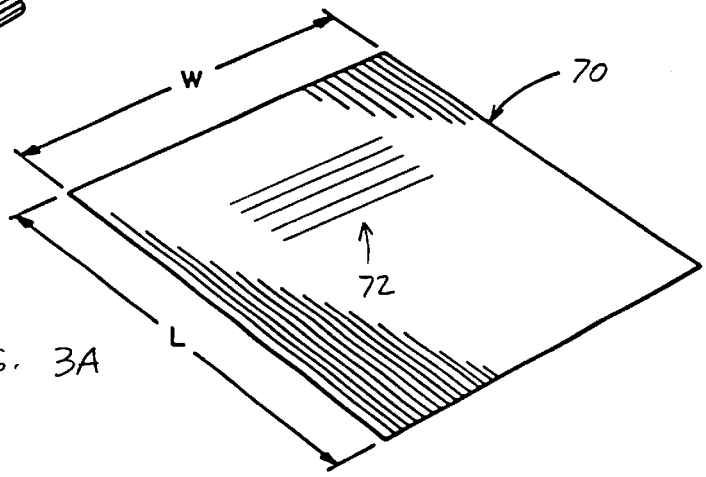
FIGS. 3A–3I illustrate the manner in which the informational item of FIG. 3 is formed.
Figure 3B:
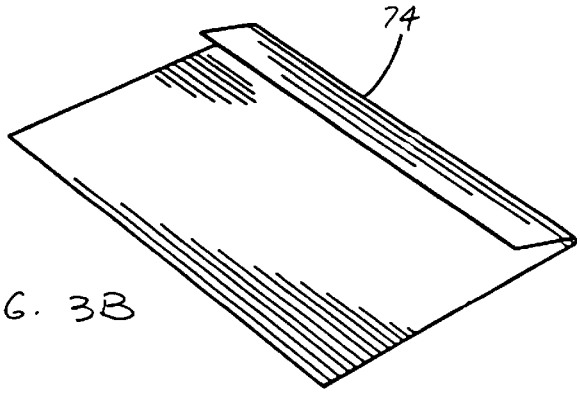
Figure 3C:
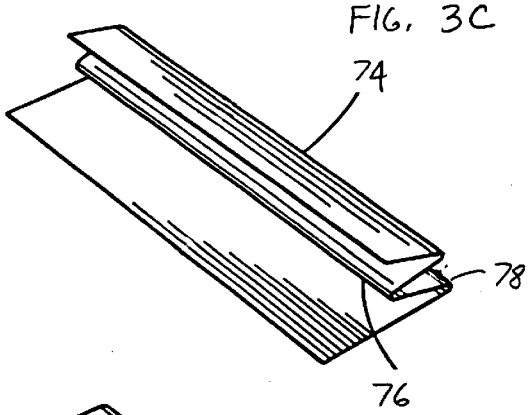
Figure 3D:
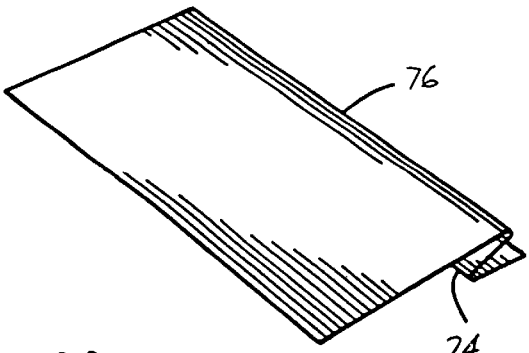

Referring to FIG. 3A, the outsert 20*b* may be formed from a sheet 70 of paper having information 72 printed thereon. The sheet 70 has a length L and a width W. Referring to FIGS. 3B–3E, a plurality of folds 74, 76, 78, 80 may be made in the sheet 70 in a direction parallel to its length to form a folded article 82 shown in FIG. 3E having a length and a width. Although the folds 74, 76, 78, 80 are shown to be alternating or accordion-type folds, the folds could be made in other ways, such as by successively folding the sheet 70 in half.

Figure 3E:
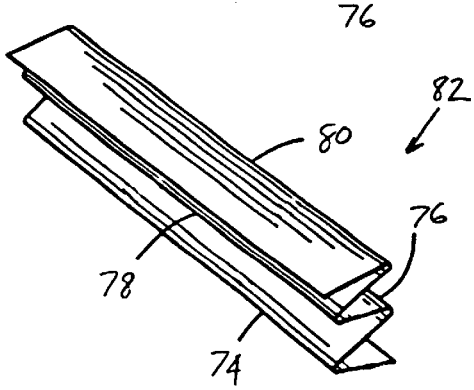
Figure 3F:
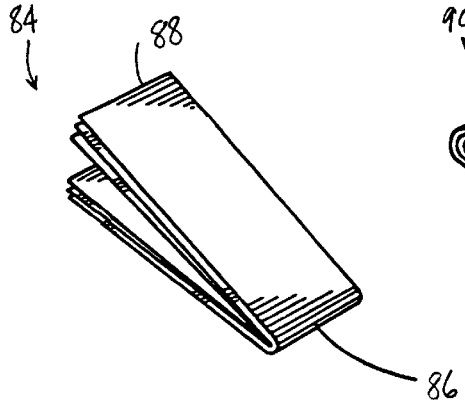

Referring to FIG. 3F, the folded article 82 shown in FIG. 3E is then folded in a direction parallel to the width of the folded article 82 and perpendicular to its length to form a folded article 84 having a first end that is composed of a fold or folded edge 86 and a second end composed of a plurality of unfolded sheet edges 88.

Figure 3G:
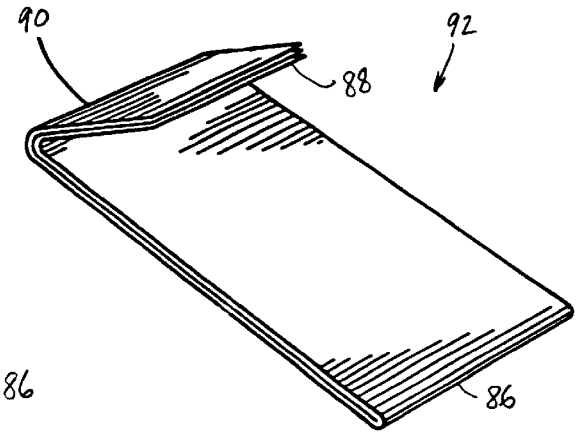

Referring to FIG. 3G, the folded article 84 shown in FIG. 3F is then folded again by making a fold 90 in the same direction as the fold 86 made in FIG. 3F to form a folded article 92. The folded article 92 has a first end that is composed of the folded edge 86 and a second end composed of the fold or folded edge 90. The fold 90 of FIG. 3G is made so that the unfolded sheet edges 88 are disposed between two folded edges 86, 90.

Figure 3H:
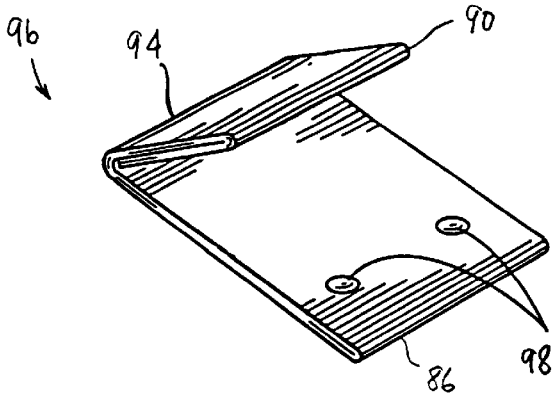

Referring to FIG. 3H, the folded article 92 shown in FIG. 3G is then folded again by making a fold 94 in a direction parallel to the fold 90 to form a folded article 96, the fold 94 being made so that the fold 90 is disposed between the fold 86 and the fold 94. One or more drops of adhesive 98 may be applied to the folded article 96.

Figure 3I:
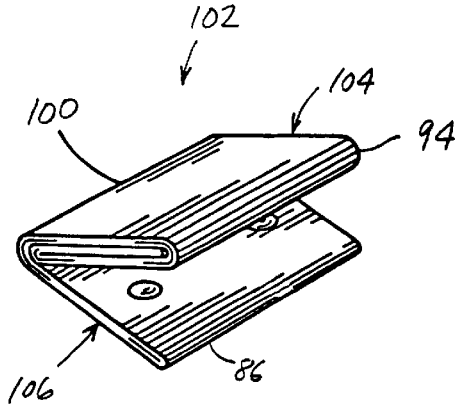

Referring to FIG. 3I, the folded article 96 shown in FIG. 3H is then folded again by making a fold 100 in the same direction to form a folded article 102. The fold 100 may be made at a point along the folded article 96 SO that the folded edges 86, 94 are disposed directly adjacent each other. The folded article 102 has an upper portion 104 composed of a plurality of sheet thicknesses and a lower portion 106 composed of a plurality of sheet thicknesses. When the upper portion 104 makes contact with the adhesive 98 disposed on the lower portion 106, the adhesive 98 bonds the upper and lower portions 104, 106 together to form the substantially closed outsert 20*b* shown in FIG. 3 having no exterior unfolded sheet edges that lie in a direction parallel to the fold 100.

While two methods of forming outserts are described above, it should be understood that other methods of forming outserts could be utilized, such as those disclosed in U.S. Pat. No. 4,817,931 to Vijuk and U.S. Pat. No. 5,813,700 to Vijuk, et al., which are incorporated by reference herein.

Methods of Forming Booklets

Figure 4A:
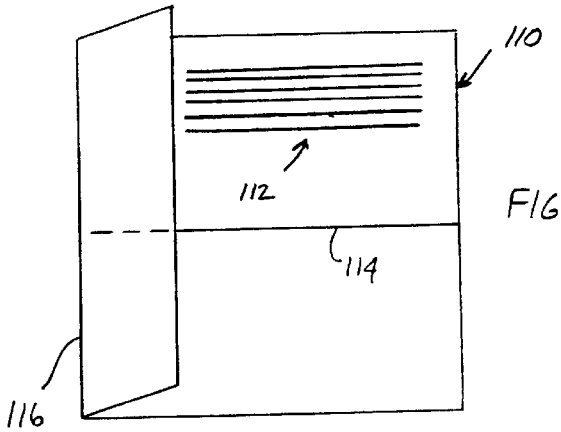
FIGS. 4A–4H illustrate a manner of forming several additional embodiments of the informational items of FIG. 1.

FIGS. 4A–4F illustrate a method of forming a booklet 20*c* (FIG. 4F) which may be included as one of the informational items 20 in the stack 10 of FIG. 1. Referring to FIG. 4A, the booklet 20*c* may be formed from a sheet of paper 110 having information 112 printed thereon. A portion of an adhesive 114 is applied across the sheet 110 in a generally linear direction, and then a fold 116 is made in the sheet 110 in a direction perpendicular to the adhesive 114.

Figure 4D:
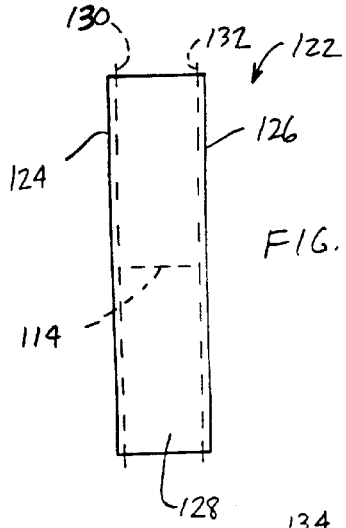
Figure 4B:
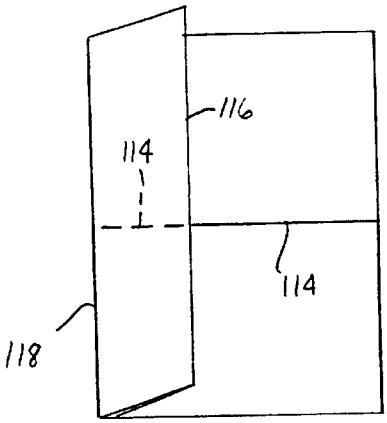
Figure 4E:
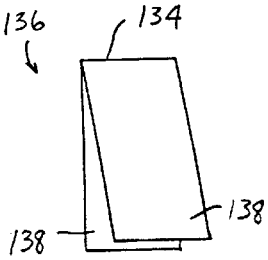
Figure 4F:
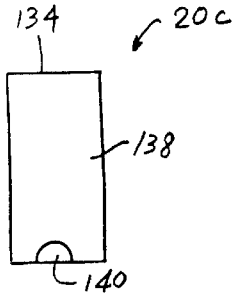
Figure 4C:
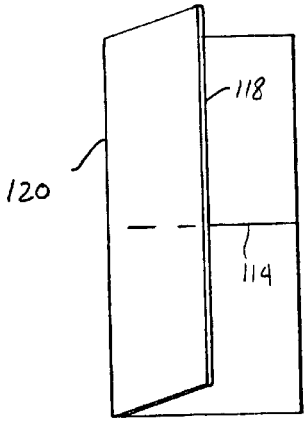

Referring to FIGS. 4B and 4C, a number of additional folds 118, 120 are made in a direction parallel to the first fold 116 and perpendicular to the adhesive 114 to result in an article 122 shown in FIG. 4D. The article 122 has a first side 124 and a second side 126 both of which are parallel to its length and each of which is composed of a plurality of folds which are integral with and which join together a plurality of sheet panels 128, each of which is bonded to at least one other sheet panel 128 via the adhesive 114. A pair of cuts or slits are then made in the article 122 along a pair of dotted lines 130, 132 in order to remove the folds disposed along the sides 124, 126 of the article 122 and cause the sheet panels 128 to become separated so that the sheet panels 128 can be moved relative to each other like the pages of a book.

Referring to FIG. 4E, the article 122 of FIG. 4D is then folded at a fold 134 that is coincident with the adhesive 114 to form an article 136 having a folded or bound edge consisting of the fold 134 and a plurality of pages or sheets 138 joined together at the bound edge 134. Referring to FIG. 4F, a closure member 140, such as a circularly shaped piece of adhesive-backed paper, may be applied to the ends of the sheets 138 opposite the bound edge 134 to form the booklet 20*c*.

Figure 4G:
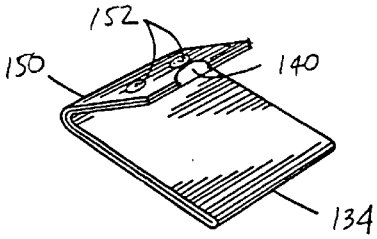
Figure 4H:
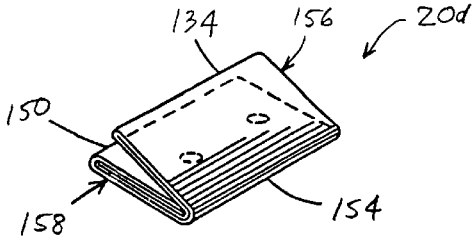

The booklet 20*c* may alternatively be provided as a folded booklet. Referring to FIG. 4G, the booklet 20*c* may be converted into a folded booklet 20*d* (FIG. 4H) by making a first fold 150 in the booklet 20*c* in a direction parallel to the bound edge 134 and by applying an adhesive 152, as shown in FIG. 4G, and then by making a second fold 154 in a direction parallel to the fold 150, as shown in FIG. 4H, so that an upper portion 156 composed of a plurality of sheets 138 is bonded to a lower portion 158 composed of a plurality of sheets 138 to form the folded booklet 20*d* having no exterior unfolded sheet edges that lie in a direction parallel to the fold 154.

While several methods of forming booklets are described above, it should be understood that other methods of forming booklets could be utilized, such as those disclosed in U.S. Ser. No. 09/326,821 filed in the U.S. Patent Office on Jun. 7, 1999, which is incorporated by reference herein.

Outsert Forming and Bonding Machine

Figure 5:
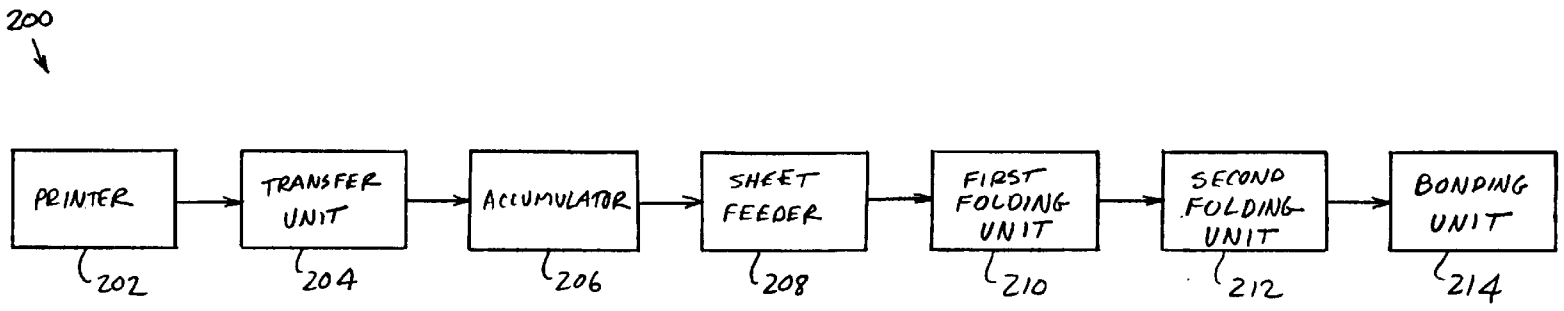
FIG. 5 is an overall block diagram of an outsert forming and bonding apparatus.

FIG. 5 is a block diagram of an embodiment of an outsert forming and bonding apparatus 200 that could be used to perform the outsert-forming methods described above. Referring to FIG. 5, the apparatus 200 may include a printer 202, which may be in the form of a web printer that prints textual subject matter on a paper web (not shown) provided to the printer 202 and cuts the paper web into individual sheets after it is printed. The printer 202, which may also make one or more folds in the individual sheets, produces a stream of printed sheets which may be provided to a sheet transfer unit 204. The stream of sheets may be in the form of a shingled stream, in which case the sheets are overlapping each other in a conventional manner. Each of the sheets in the stream may be unfolded, or may have one or more folds formed therein.

The transfer unit 204 may act to transfer the sheets to an accumulator station 206, at which the sheets may temporarily accumulate in a stack of sheets, before being provided by an automatic sheet feeder 208 to a first folding unit 210 that may make a plurality of folds in a first direction. The accumulator station 206 may be designed to accumulate sheets due to differences in the sheet processing capacity between the printer 202 and the first folding unit 210. The folded articles produced by the first folding unit 210 are automatically conveyed to a second folding unit 212 that may make a plurality of folds in a second direction perpendicular to the first direction to produce outserts. The outserts formed by the second folding unit 212 are automatically conveyed to a bonding unit 214. The bonding unit 214 bonds together the individual outserts into a stack of outserts, such as the stack 10 shown in FIG. 1.

Transfer Unit 204

Figure 7:
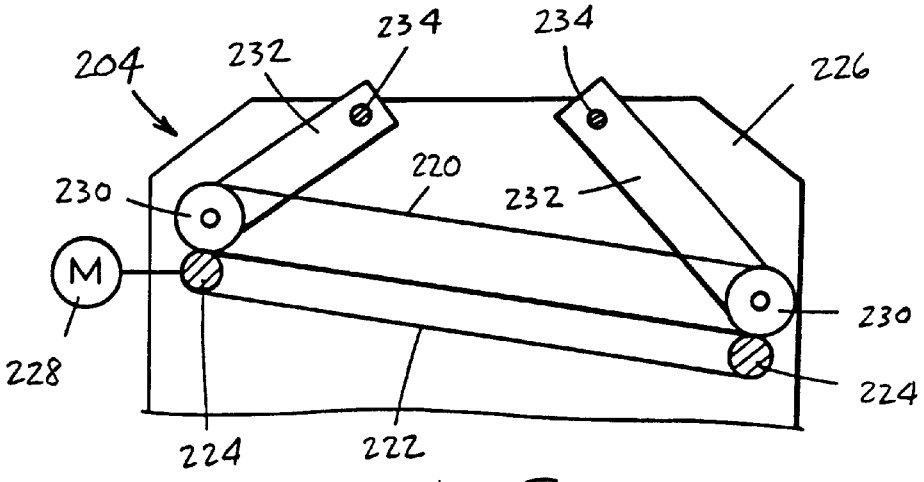
FIG. 7 is a side view of the transfer unit shown schematically in FIG. 5.

FIG. 7 is a side view of a portion of the sheet transfer unit 204 shown schematically in FIG. 5. Referring to FIG. 7, the transfer unit 204 may have a plurality of upper conveyor belts 220 and lower conveyor belts 222 between which the stream of sheets from the printer 202 passes. The lower belts 222, which may be in the form of flat belts composed of fabric having a non-slip coating, are supported by a plurality of rotatable metal rods 224 supported by a pair of frame members 226 (only one of which is shown), at least one of the rods 224 being rotatably driven by a motor shown schematically at 228.

The upper belts 220, which may be composed of rubber and which may have a circular cross section, may be supported by a plurality of rollers 230, each of which may be rotatably supported by a respective pivot arm 232 connected to one of a pair of pivot rods 234 supported between the frame members 226. The upper belts 220 may be sized so that, when they are placed onto the rollers 230, the tension of the upper belts 220 forces the pivot arms 232 downwards so that the upper belts 220 and the lower belts 222 make sufficiently firm contact with the stream of sheets to ensure that the sheets do not move relative to one another as they are transferred from the printer 202 to the accumulator station 206 by the transfer unit 204.

Accumulator Station 206

Figure 8A:
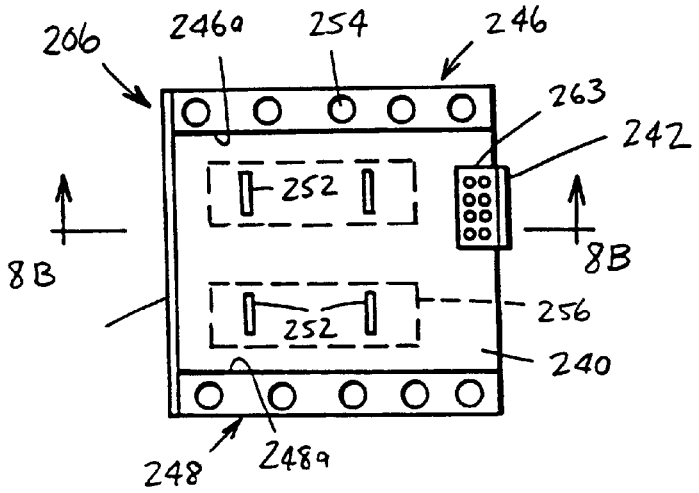
FIG. 8A is a top view of the accumulator station shown schematically in FIG. 5.
Figure 8B:
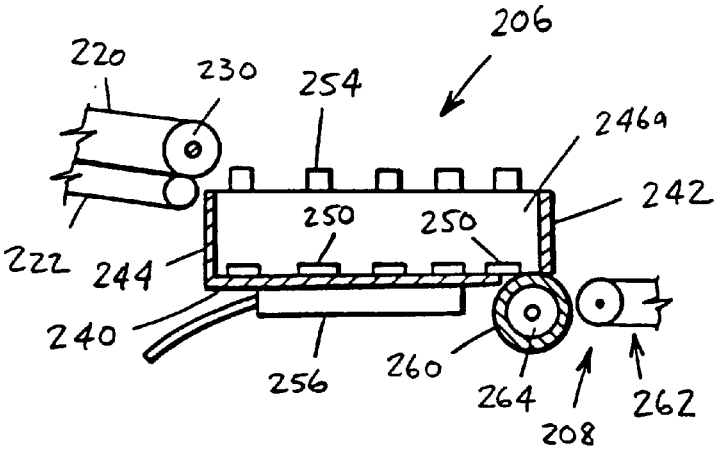
FIG. 8B is a cross-sectional side view of the accumulator station taken along lines 8B–8B of FIG. 8A.

FIGS. 8A and 8E illustrate the basic structure of one embodiment of the accumulator station 206 shown schematically in FIG. 5. Referring to FIGS. 8A and 8B, the accumulator station 206 has a flat base plate 240, a front plate 242, a rear wall 244, and a pair of elongate hexahedral side members 246, 248 each having a respective inner side surface 246*a*, 248*a*. As shown in FIG. 8B, the upper and lower conveyor belts 220, 222 of the transfer unit 204 are positioned so as to deposit sheets into the hexahedral space defined by the base plate 240, the front plate 242, the rear wall 244, and the side surfaces 246*a*, 248*a*.

Pressurized air is forced against the lower portion of the stack of sheets in the accumulator station 206 in a conventional manner to slightly levitate the lowermost sheets to reduce the coefficient of friction between the lowermost sheet in the stack and the base plate 240 and to provide slight physical separation between the lowermost sheets in the stack. The pressurized air is provided by a number of apertures 250 formed in each of the inner side surfaces 246*a*, 248*a* and a number of apertures 252 formed in the base plate 240.

The side members 246, 248, which act as pneumatic pressure manifolds, have a hollow interior which is divided into a number of individual pressure compartments, each of which is pneumatically coupled to a source of pressurized air (not shown) and to a respective one of the apertures 250 in the side surfaces 246*a*, 248*a*. The pressure of the air provided through each aperture 250 may be varied by a respective regulator knob 254 associated with each of the pressure compartments by an internal valve structure shown and described in U.S. Pat. No. 4,616,815 to Michael Vijuk, the disclosure of which is incorporated herein by reference.

Pressurized air may be provided to the apertures 252 formed in the base plate 240 via one or more pressure manifolds 256 disposed beneath the base plate 240. Pressurized air may also be provided through a number of apertures (not shown) formed in the rear wall 244. The particular design of the accumulator station 206 described above is not considered important to the invention, and other designs could be used. Sheet transfer units, accumulator stations, and automatic folding machines of the type described above are commercially available from Vijuk Equipment Co. of Elmhurst, Ill.

Sheet Feeder 208

Figure 9A:
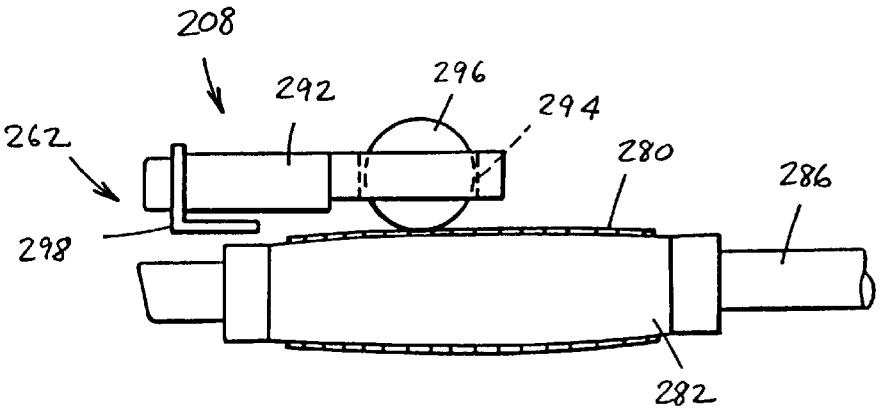
FIG. 9A is a side view of a portion of the sheet feeder shown schematically in FIG. 5.
Figure 9B:
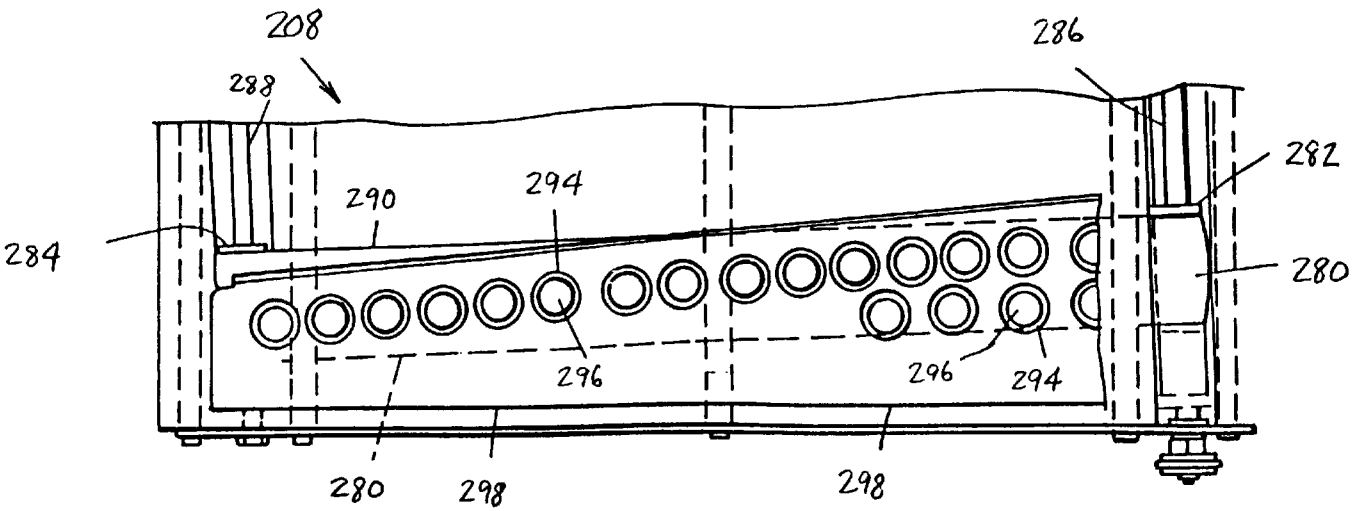
FIG. 9B is a top view of a portion of the sheet feeder of FIG. 9A.

FIGS. 8B, 9A and 9B illustrate the sheet feeder 208 shown schematically in FIG. 5. Referring to FIG. 8B, the sheet feeder 208 has a first part in the form of a vacuum drum or roll 260 and a second part in the form of a conveyor 262. The vacuum roll 260, which is controlled to periodically remove the lowermost sheet from the bottom of the stack of sheets, may be provided in the form of a hollow cylindrical drum having a plurality of holes formed in its cylindrical outer surface and is positioned directly beneath a rectangular aperture 263 formed in the base plate 240. The vacuum roll 260 has a hollow interior portion 264 in which a reduced or suction pressure may be selectively provided. To that end, the interior of the vacuum roll 260 is pneumatically coupled to a vacuum pump (not shown) via a pneumatic line (not shown) and a pneumatic valve (not shown) that is adapted to selectively open and close the pneumatic line.

FIGS. 9A and 9B illustrate the structure of the conveyor 262 shown schematically in FIG. 8B. Referring to FIGS. 9A and 9B, the conveyor 262 has a conveyor belt 280 driven by a pair of spaced rollers 282, 284 each of which is rotatably driven by a respective drive rod 286, 288. The conveyor 262 also includes a sheet alignment mechanism 290 positioned directly over the conveyor belt 280. The alignment mechanism 290 includes a retainer arm 292 having a plurality of cylindrical bores 294 formed therein, a respective metal ball 296 disposed within each of the bores 294, and an L-shaped side guide 298 connected to the retainer arm 292.

Sheets from the accumulator station 206 are periodically and individually fed by the vacuum roll 260 to the conveyor 262 so that they pass between the bottom of the metal balls 296 and the top of the conveyor belt 280. The weight of the metal balls 296 resting on top of the sheets maintains the alignment of the sheets relative to the conveyor belt 280. As shown in FIG. 9B, the side guide 298 is angled slightly relative to the conveyor belt 280. Consequently, as the sheets pass through the conveyor 262 (from right to left in FIG. 9B), the side edges of the sheets are gradually moved against the edge of the side guide 298, which movement causes the side edges of the sheets to become justified or flush against the side guide 298 for proper alignment as the sheets enter the first folding apparatus 210.

Further details regarding the design and operation of the accumulator 206 and sheet feeder 208 are disclosed in U.S. Ser. No. 09/047,716 filed in the U.S. Patent Office on Mar. 25, 1998, which is incorporated herein by reference.

Folding Units 210, 212

Figure 10A:
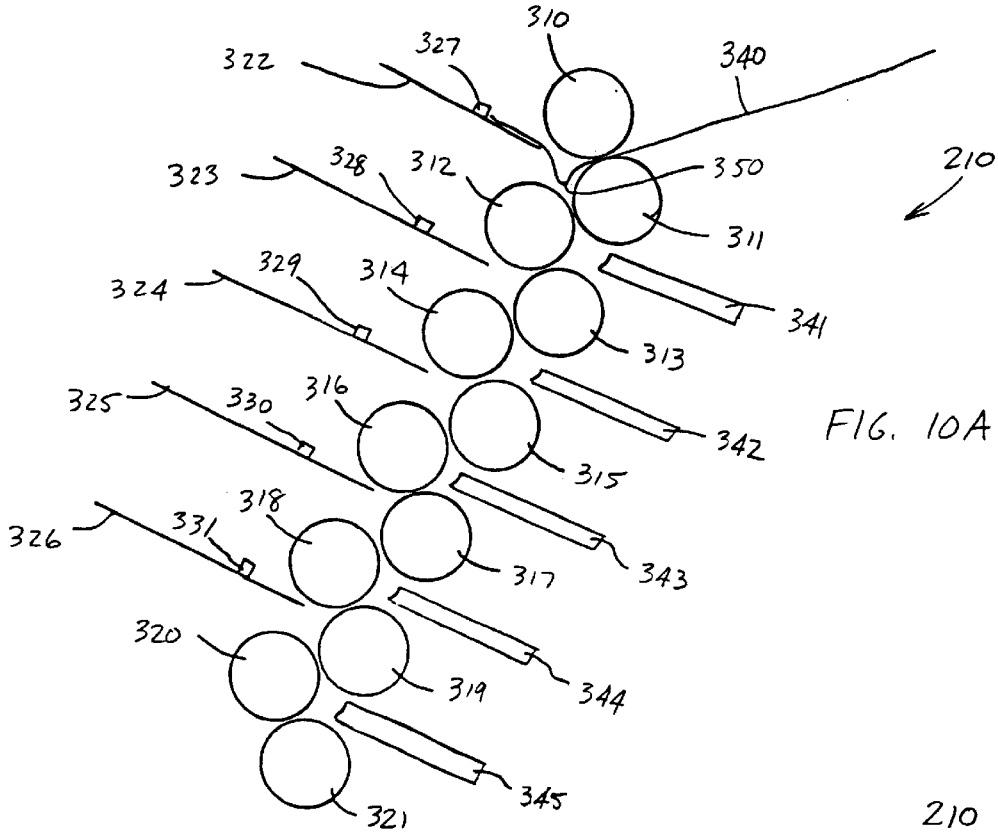
FIGS. 10A and 10B illustrate one embodiment of the first folding unit shown schematically in FIG. 5.
Figure 10B:
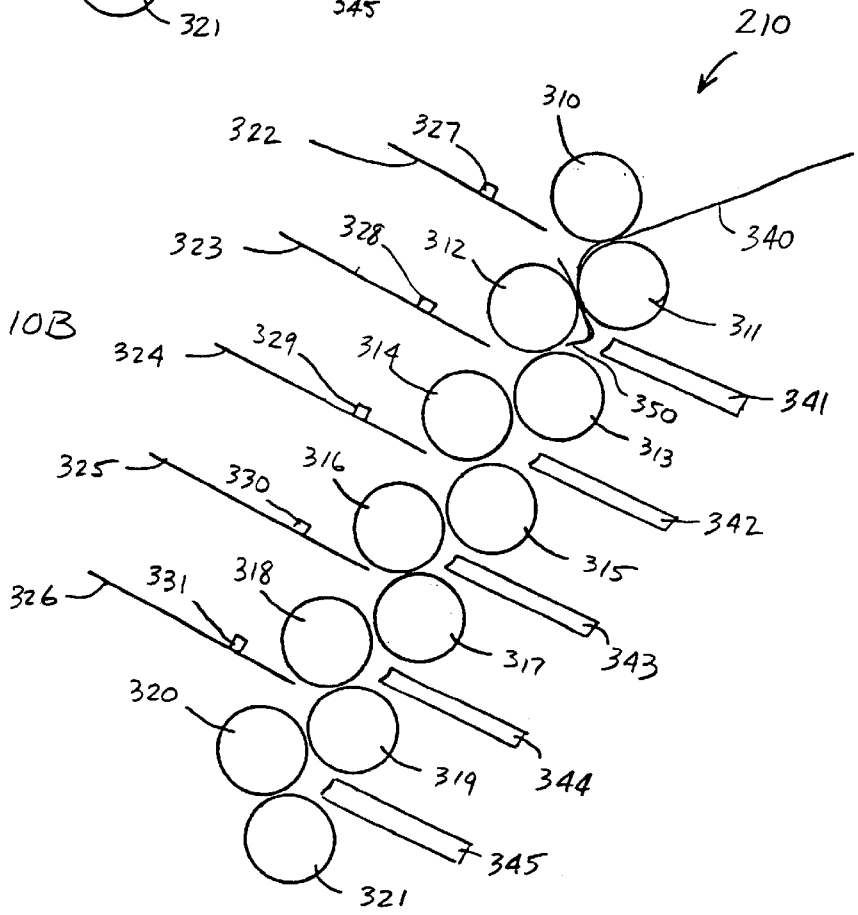

FIGS. 10A and 10B are schematic side views of an embodiment of the first folding unit 210 shown as a block in FIG. 5. The first folding unit 210 may be used to make one or more folds in an unfolded sheet of paper, all of the folds being parallel to each other. Referring to FIG. 10A, the folding unit 210 may be provided with a plurality of cylindrical folding rollers 310-321, a plurality of folding plates 322-326 each of which is provided with one of a plurality of stops 327-331 that are positioned to stop the leading edge of an article 340 passing through the folding unit 210 at desired positions, and a plurality of deflectors 341-345, each of which causes the leading edge of the article 340 passing through the folding unit 210 to be deflected towards the next pair of folding rollers.

When it first enters the first folding unit 210, the article 340 shown in FIGS. 10A and 10B may correspond to an unfolded sheet of paper, such as the sheet of paper 30 shown in FIG. 2A or the sheet of paper 70 shown in FIG. 3A. When the leading edge of the article 340 hits the stop 327, an intermediate portion of the article at a point 350 is forced downwardly towards the nip of the folding rollers 311, 312. When the point 350 passes between the folding rollers 311, 312, the article 340 is folded at the point 350 by the folding rollers 311, 312 and then deflected by the end of the deflector 341 towards the nip of the folding rollers 312, 313, as shown in FIG. 10B.

The process continues in a similar manner until all of the desired folds are made in the article 340. The folding unit 210 shown in FIGS. 10A and 10B would make five folds in the article 330. The number of folds and the positions at which they are made could be varied in a known manner by varying the number and/or position of the folding rollers 310-321, the folding plates 322-326 and the deflector plates 341-345.

Figure 11A:
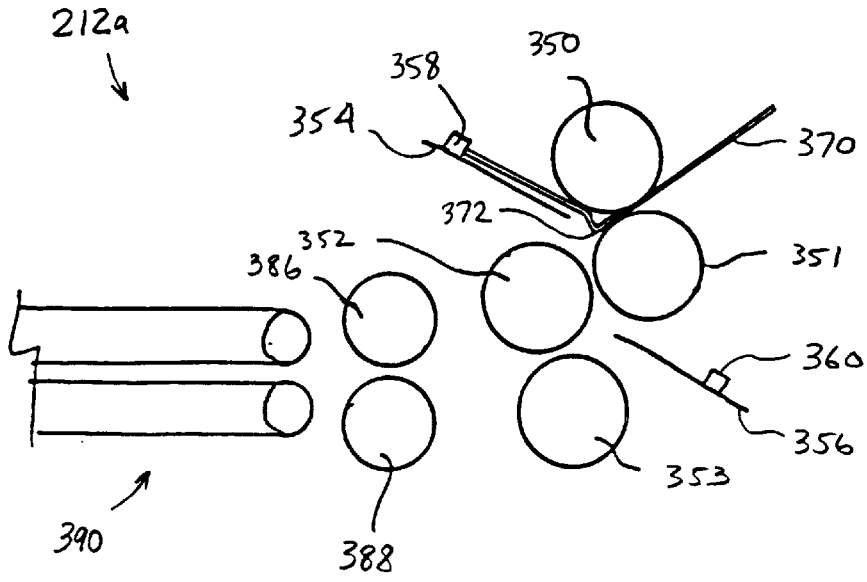
FIGS. 11A–11D illustrate a first portion of one embodiment of the second folding unit shown schematically in FIG. 5.

FIG. 11A is a side view of a first apparatus portion 212*a* of the second folding unit 212 shown schematically in FIG. 5. The second folding unit 212 may be used to make one or more folds in an article in a direction perpendicular to the direction in which one or more initial folds were made. Referring to FIG. 11A, the second folding unit 212 may be provided with a plurality of cylindrical folding rollers 350-353, a pair of folding plates 354, 356, each of which is provided with one of a pair of stops 358, 360 that are positioned to stop the leading edge of an article 370 passing through the folding unit 212 at desired positions.

Figure 11B:
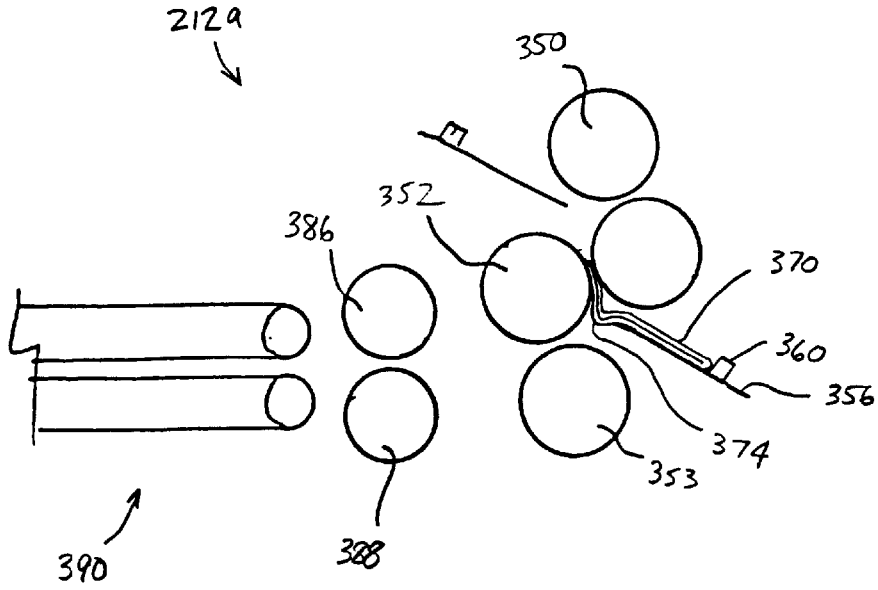
Figure 11C:
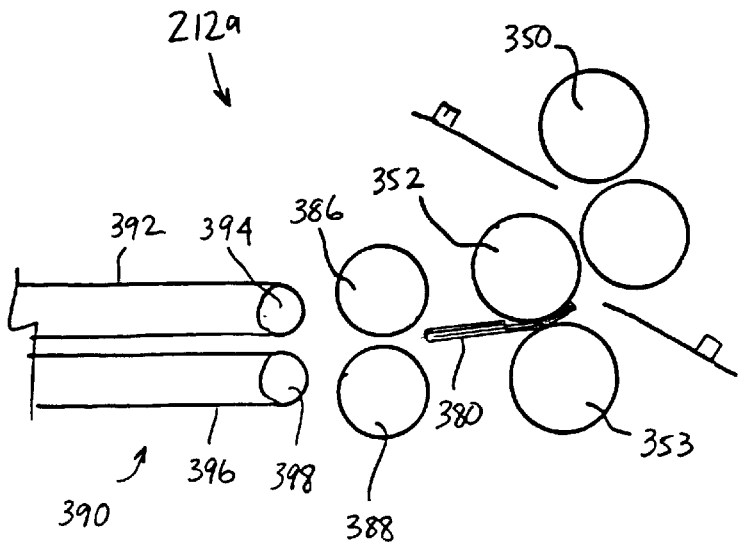

When it first enters the first folding unit 212, the article 370 shown in FIG. 11A may correspond to a folded article having a plurality of parallel folds made in a first direction, such as the folded article 40 shown in FIG. 2B or the folded article 82 shown in FIG. 3E. When the leading edge of the article 370 hits the stop 358, an intermediate portion of the article at a point 372 is forced downwardly towards the nip of the folding rollers 351, 352. When the point 372 passes between the folding rollers 351, 352, the article 370 is folded at the point 372 by the folding rollers 351, 352, and then the leading folded edge 372 of the article 370 moves along the folding plate 356 until it makes contact with the stop 360, as shown in FIG. 11B. As the rear portion of the article 370 continues to advance, an intermediate portion of the article 370 buckles at a point 374 and moves downwardly towards the nip of the folding rollers 352, 353. When the point 374 passes between the folding rollers 352, 353, it is folded by the folding rollers 352, 353, as shown in FIG. 11C. At that point, the article 370 has a leading portion 380 and a trailing portion 382, with the leading portion 380 being twice as thick as the trailing portion 382, which is shown most clearly in FIG. 11D.

Figure 11D:
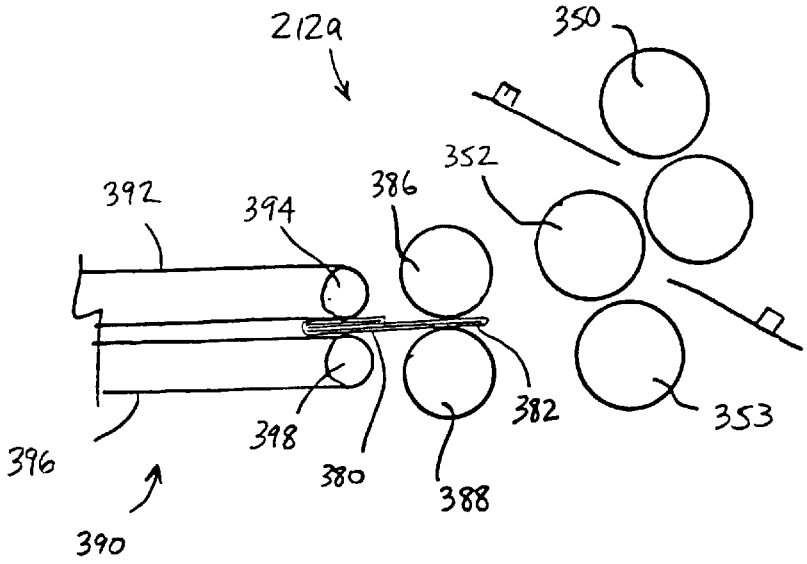

Referring to FIGS. 11C and 11D, the article 370 may be passed through a pair of cylindrical flattening rollers 386, 388 and then to a conveyor 390, which may be provided with one or more upper conveyor belts 392 supported by a plurality of cylindrical rollers 394 and one or more lower conveyor belts 396 supported by a plurality of cylindrical rollers 398.

Figure 12A:
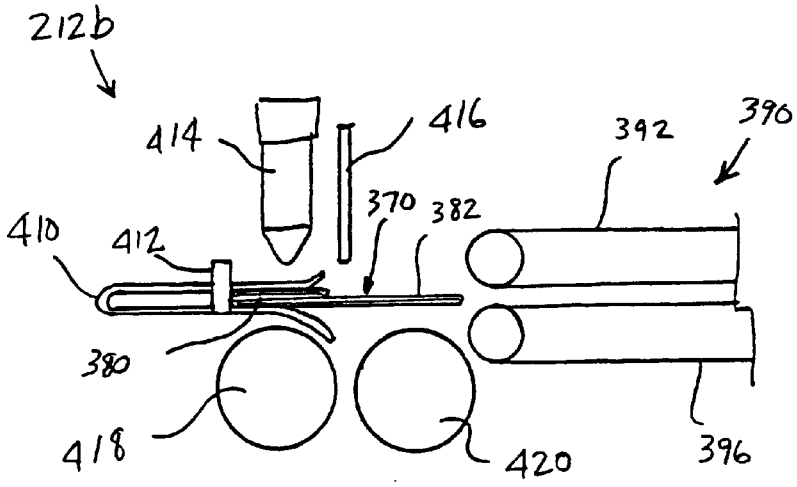
FIGS. 12A and 12B illustrate a second portion of one embodiment of the second folding unit shown schematically in FIG. 5.
Figure 12B:
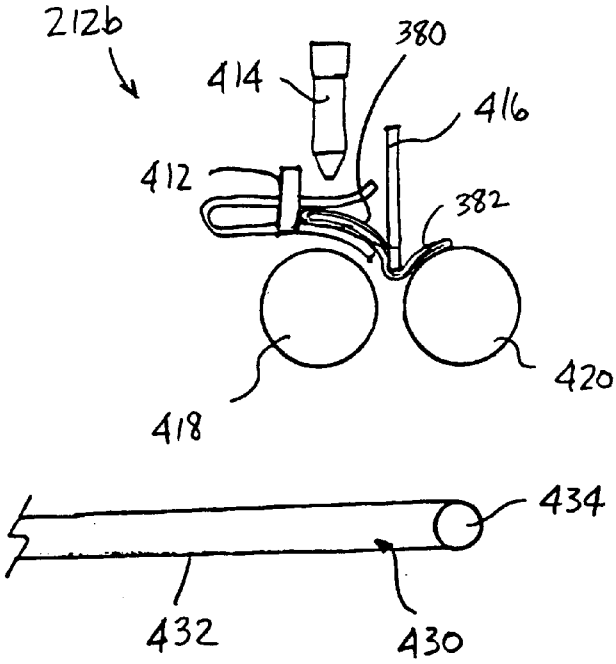

The second folding unit 212 may be provided with a section 212*b* as shown in FIGS. 12A and 12B. Referring to FIGS. 12A and 12B, the section 212*b* may be provided with guide member 410, a stop member 412 associated with the guide member 410, one or more glue applicators 414, a linearly translatable deflection or knife member 416, a pair of rotatable cylindrical folding rollers 418, 420, and a conveyor 430.

Referring to FIGS. 12A and 12B, after the folded article 370 exits the conveyor 390, the leading edge of the folded article 370 abuts against the stop member 412. With the folded article 370 in that position as shown in FIG. 12A, the bottom edge of the deflection member 416 is positioned generally in the middle of the folded article 370 at the intersection between the relatively thick leading portion 380 and the relatively thin trailing portion 382.

With the folded article 370 so positioned, one or more spots of glue may be deposited onto the upper surface of the relatively thick leading portion 380, and then the deflection member 416 may be moved downwardly so that it makes contact with an intermediate portion of the folded article 370 and so that it pushes the intermediate portion towards the nip between the folding rollers 418, 420, as shown in FIG. 12B. As the folded article 370 passes through the folding rollers 418, 420, the article 370 will be folded so that the portion 382 is folded over the portion 380, with the glue spots disposed between the two portions 380, 382 so that the resulting outsert remains in a substantially closed orientation with the portions 380, 382 adhered together.

The outsert is then automatically conveyed by the conveyor 430, which may be provided with one or more endless conveyor belts 432 and a plurality of rotatable conveyor rollers 434, to the bonding unit 214 shown schematically in FIG. 5.

Further details regarding folding units that could be used for the first and second folding units 210, 212 are described in U.S. Ser. No. 09/326,821 filed in the U.S. Patent Office on Jun. 7, 1999 and U.S. Pat. Nos. 4,616,815, 4,812,195, 4,817,931, 5,044,873 and 5,046,710, all of which are incorporated herein by reference.

Although a particular embodiment of the folding units 210, 212 is described above, numerous other embodiments and types of folding units could be utilized, and the particular type of folding units used is not considered important to the invention.

Bonding Unit 214

Figure 13:
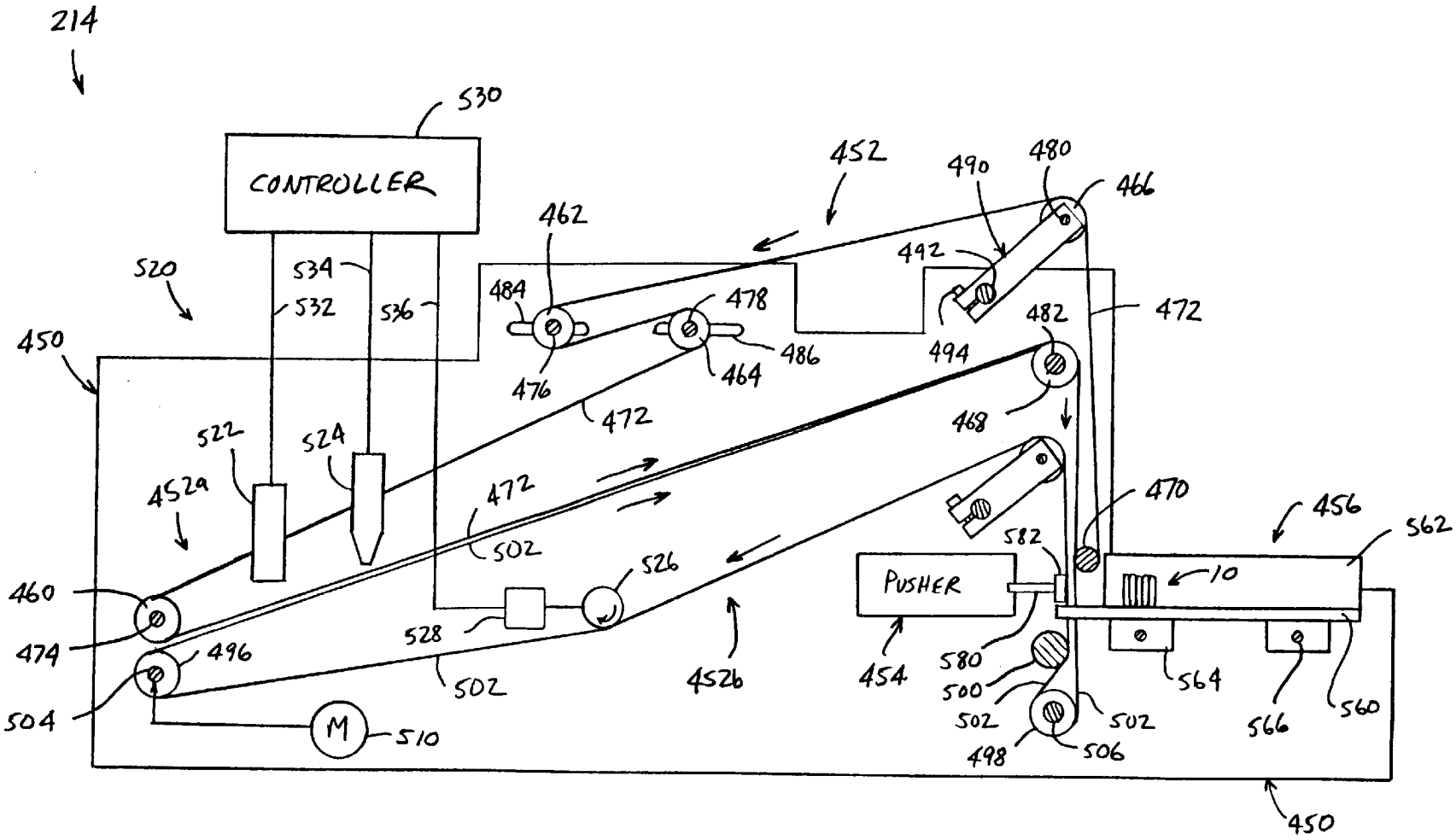
FIGS. 13, 13A and 13B illustrate the bonding apparatus shown schematically in FIG. 5.

FIG. 13 is a cross-sectional side view of one embodiment, with portions shown schematically, of the bonding unit 214 shown in FIG. 5. Referring to FIG. 13, the bonding unit 214 may be provided with a pair of spaced-apart support frames 450, a conveyor unit 452 having an upper conveyor assembly 452*a* and a lower conveyer assembly 452*b*, a pusher unit 454, and a guide tray 456 that supports one or more stacks 10 of informational items 20.

Figure 13A:
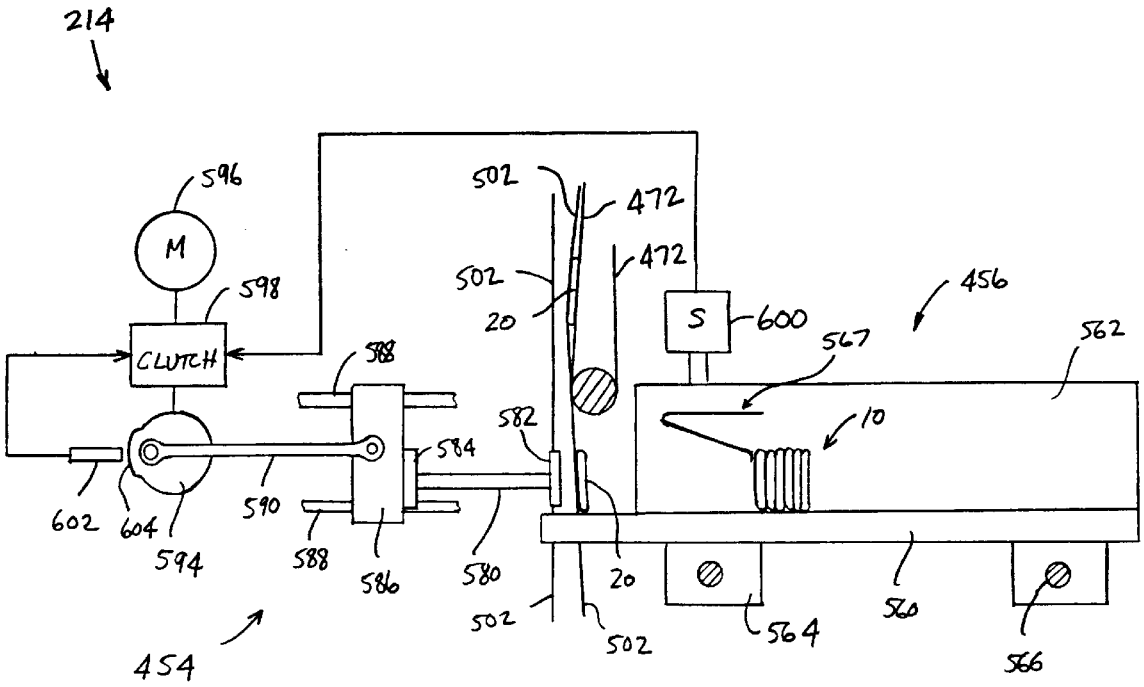
Figure 13B:
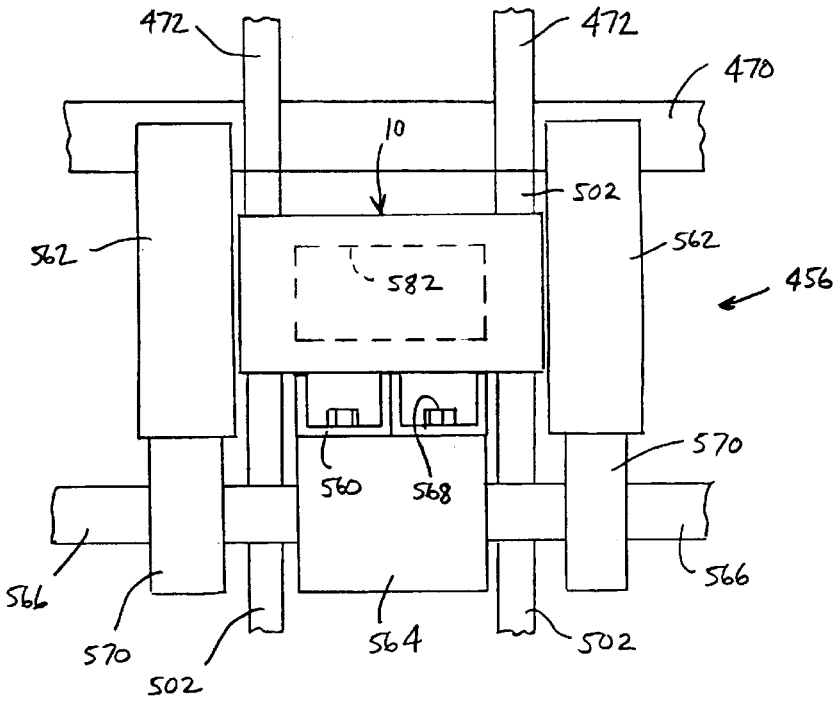

The upper conveyor unit 452*a* may be provided with a plurality of support rollers 460, 462, 464, 466, 468 and a rotatable rod 470 which support a plurality of endless conveyor belts 472. Referring also to FIG. 13B, at least two spacedapart conveyor belts 472 and two sets of rollers 460, 462, 464, 466, 468 may be utilized. The support rollers 460, 462, 464, 466, 468 may be supported by a plurality of support rods 474, 476, 478, 480, 482 which may be supported by the spaced-apart support frames 450.

The support rods 476, 478 may be disposed through a pair of slots 484, 486 formed in each of the support frames 450 so that the distance between the rollers 462, 464 can be adjusted in order to adjust the tension on the conveyor belts 472. The support rods 476, 478 may be fixed at a particular desired position within the slots 484, 486 by tightening end caps (not shown) threaded onto the ends of the rods 476, 478 or by utilizing other fastening structures.

The rods 480 that support the rollers 466 may be connected to support arms 490 that are fixed to a rod 492 connected between the frame supports 450. The angular position of the support arms 490 may be adjusted and then fixed via tightening bolts 494.

The lower conveyor unit 452*b* may be provided with a plurality of support rollers 496, 498 and a rotatable rod 500 which support a plurality of endless conveyor belts 502. The rollers 468 may support both of the conveyor belts 472, 502. The support rollers 496, 498 may be supported by a plurality of support rods 504, 506, which may be supported by the spaced-apart support frames 450.

The rollers 496 may be fixed to the support rod 504, the support rod 504 may be rotatable, and a motor 510 may be coupled to rotatably drive the support rod 504 via a gearing system (not shown) comprising one or more drive gears. The gearing system may include a pair of intermeshed gears that simultaneously cause the rods 474, 504 to rotate at the same rate in opposite directions so that the conveyor belts 472, 502 are driven in the direction indicated by the arrows in FIG. 13.

The bonding unit 214 may be provided with a glue application system 520. The glue application system 520 may be provided with a sensor 522 that is capable of detecting the passage of informational items 20, one or more glue applicators 524 that apply one or more drops of glue to informational items 20, a sensing wheel 526, a rotary encoder 528, and a controller 530 that is operatively coupled to the sensor 522, the glue applicator(s) 524, and the rotary encoder 528 via a plurality of signal lines 532, 534, 536, respectively.

Figure 14:
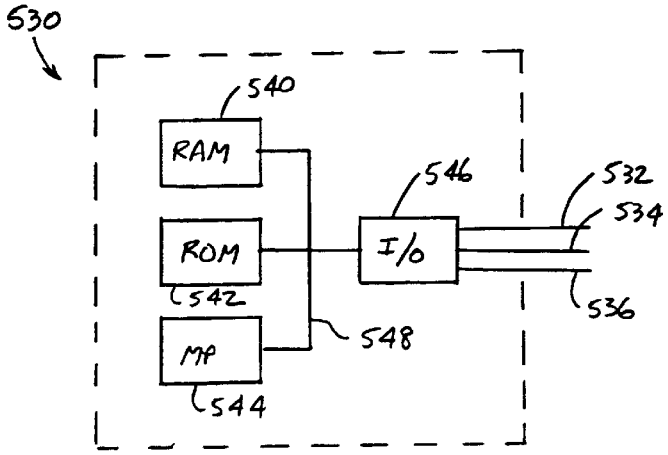
FIG. 14 is a block diagram of one embodiment of the controller shown schematically in FIG. 13.

Referring to FIG. 14, the controller 530 may be provided with a random-access memory (RAM) 540, a program memory such as a read-only memory (ROM) 542, a microprocessor 544, and an input/output (I/O) circuit 546, all of which are interconnected by an address/data bus 548. In that case, a computer program may be stored in the ROM 542 and executed by the microprocessor 544 to control the operation of the glue application system 520. Alternatively, the controller 530 could be implemented as a logic circuit, a programmable logic array, or another electrical control apparatus or circuit.

Referring to FIG. 13, the guide tray 456 may be provided with one or more base members 560 and a plurality of spaced-apart side walls 562. The base members 560 may be supported on a plurality of mounting blocks 564, each of the mounting blocks 564 having a cylindrical hole formed therein through which a cylindrical rod 566 passes. The ends of each of the cylindrical rods 566 may be supported by the spaced-apart support frames 450. As shown in FIG. 13A, the interior face of each of the side walls 562 may be provided with a retention clip 567, which may act to retain the upright position of the rearmost item 20 in the stack 10 or which may act to apply a pressure to the rearmost item 20 in the stack 10 to facilitate bonding of the rearmost item 20 to the stack 10.

Referring to FIG. 13B, which is an end view of the guide tray 456 looking from right to left in FIG. 13A, the base members 560 may have a U-shaped cross section, and the base members 560 may be connected to the mounting blocks 564 via a plurality of bolts 568. The lateral position of the base members 560 may be adjusted by sliding the mounting blocks 564 along the rods 566, and the lateral position may be fixed with a set screw (not shown) or another position-fixing device.

Each of the side walls 562 may be fixed to one or more mounting blocks 570 through which the cylindrical rods 566 pass. The side walls 562 may be spaced apart by a distance substantially corresponding to, or slightly larger than, the width of the stack 10 of informational items 20, as shown in FIG. 13B. The lateral positions of the side walls 562 may also be adjusted by sliding the mounting blocks 570 along the rods 566, and the side walls 562 may be fixed in a particular lateral position via a set screw (not shown) or other means.

Referring to FIG. 13A, the pusher unit 454 may be provided with a laterally extending pusher arm 580 having a pusher plate 582 attached thereto. The pusher arm 580 may be connected to a mounting plate 584 which may in turn be connected to a slide block 586 which is slidably supported by a plurality of slide rods 588. The slide block 586 may be connected to a drive arm 590 having a first end connected to the slide block 586 and a second end connected to a rotatable drive wheel 594. The drive wheel 594 may be rotatably driven by a motor 596 through a clutch mechanism 598.

The clutch 598 may be operatively coupled to a first sensor 600 that detects the presence of one of the informational items 20 as it moves downwardly between the upper and lower conveyor belts 472, 502 and to a second sensor 602 that senses the angular position of the drive wheel 594. For example, the sensor 602 may be a magnetic proximity sensor that detects when an enlarged portion 604 of the drive wheel 594 is adjacent the sensor 602.

Referring to FIG. 13, in the operation of the bonding unit 214, informational items 20 (not shown in FIG. 13) may be automatically provided, one at a time, to the nip or intersection of the upper and lower conveyor belts 472, 502 at the left-hand portion of the bonding unit 214 which is disposed immediately adjacent the support rollers 460, 496. The informational items 20 may be automatically provided to the bonding unit 214 directly from the conveyor 430 (FIG. 12B) of the second folding unit 212, or they may alternatively be automatically provided via an intermediate conveyor (not shown) between the second folding unit 212 and the bonding unit 214, or another conveyor can be added to the bonding unit 214. The details regarding the design and number of the conveyor units used to transfer the informational items 20 from the second folding unit 212 to the bonding unit 214 are not considered important to the invention.

Each time an informational item 20 is introduced between the upper and lower conveyor belts 472, 502, it is conveyed upwardly due to the frictional contact between the conveyor belts 472, 502 and the informational item 20 and the fact that the conveyor belts 472, 502 are driven via the motor 510. As it moves upwardly and to the right in FIG. 13, the informational item 20 passes underneath the sensor 522, which detects its presence and transmits a detect signal to the controller 530 via the line 532.

When the informational item 20 passes underneath the adhesive applicator 524, which may be in the form of a nozzle, for example, the adhesive applicator 524 may apply adhesive to the upwardly disposed face of the informational item 20. Whether or not adhesive is applied to the informational item 20 depends upon whether the informational item 20 is to be bonded to a preexisting stack 10 of informational items being bonded together.

For example, if the bonding unit 214 is to form stacks 10 of informational items 20, with each stack 10 being composed of eight informational items 20 bonded together, the controller 530 may be programmed to cause the adhesive applicator 524 to not apply adhesive to the first informational item 20, then to apply adhesive to the next seven informational items 20 which successively pass underneath the adhesive applicator 524 (causing the first eight informational items 20 to be bonded together). After passage of the first eight informational items 20, the controller 530 could be programmed to then cause the adhesive applicator 524 to skip a single informational item 20 by not applying adhesive thereto, and then to apply adhesive to the next seven consecutive informational items 20. Further details regarding the controller 530 are described below.

The precise time at which adhesive is applied by the applicator 524 may be controlled based on the speed of the conveyor belts 472, 502, as sensed by the sensing wheel 526 and transmitted to the controller 530 via the rotary encoder 528, and the known path distance between the sensor 522 and the adhesive applicator 524. Thus, after sensing of an informational item 20 by the sensor 522, the controller 530 may wait a length of time, which varies with the speed of the conveyor belts 472, 502, before signaling the adhesive applicator 524 to deposit adhesive, during which waiting time the position of the informational item 20 will have changed from being beneath the sensor 522 to being beneath the adhesive applicator 524.

After passing underneath the adhesive applicator 524, the informational item 20 continues moving upwardly and to the right between the conveyor belts 472, 502 until it reaches the support wheels 468, after which the informational item 20 is conveyed downwardly between the belts 472, 502 in a generally vertical direction.

Referring to FIG. 13A, when the informational item 20 reaches a sensing position disposed horizontally adjacent the sensor 600, the sensor 600 activates the clutch 598 to cause the motor 596 to begin to rotate the drive wheel 594. As the drive wheel 594 rotates, the slide block 586 and the pusher arm 580 and pusher plate 582 which are connected thereto move from left to right in FIG. 13A.

By the time the pusher plate 582 moves rightwardly past the conveyor belt 502, the informational item 20 will have moved from its sensing position adjacent the sensor 600 to a loading position on top of the ends of the base members 560, which extend between the laterally spaced apart lower conveyor belts 502, as shown in FIGS. 13A and 13B. In the loading position, both faces of the informational item 20 are disposed vertically, and one of the faces rests against the conveyor belts 502.

With the informational item 20 in that loading position, the continued rightward movement of the pusher plate 582 will force the informational item 20 from its loading position to a contact position, in which the informational item 20 is forced against the rearward face of the last (or most leftward) informational item 20 in the stack 10 being formed. If adhesive was deposited on the forward (or rightward) face of the informational item 20, the force applied by the pusher plate 582 will cause the informational item 20 to be bonded to previous informational item 20 in the stack 10.

In order to enhance bonding efficiency, various ways of increasing the force with which the most recent informational item 20 is pushed against the stack 10 may be utilized. For example, the rightward movement of the stack 10 may be retarded by placing a weight, such as a brick or metal plate (not shown) on top of the base members 560 and to the right of the rightmost stack 10 to retard the rightward movement of the stack(s) 10. Alternatively, the base members 560 may be disposed at an inclined angle (their elevation may increase from left to right) to achieve a similar effect.

As the drive wheel 594 continues to rotate, the pusher plate 582 will be retracted back towards its starting position. When the drive wheel 594 reaches its starting position, as sensed by the sensor 602, the clutch 598 will disengage the motor 596 from the drive wheel 594 so that the pusher plate 582 will return to its position shown in FIG. 13A.

It should be understood that the structural details shown in FIG. 13A are not shown to scale and that the stroke length of the pusher plate 582 could be changed by varying the diameter of the drive wheel 594 or by changing the point at which the arm 590 connects to the drive wheel 594. At any one time, there may be multiple informational items 20 in transit within the bonding unit 214 between the starting position and a loading position on top of the base members 560.

Figure 15:
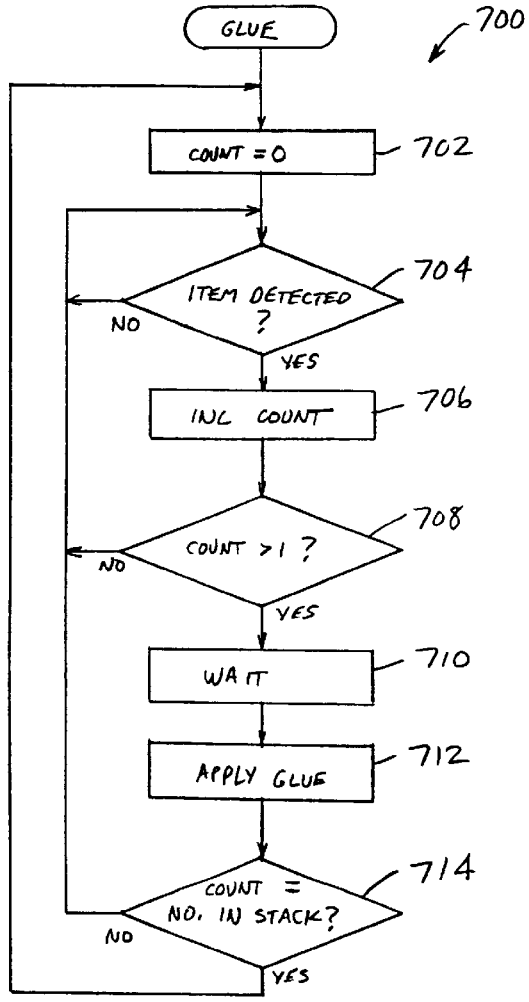
FIG. 15 illustrates a number of acts that may be performed during the process of bonding a plurality of informational items together in a stack.

Further details regarding the operation of the controller 530 are shown in FIG. 15, which illustrates a number of acts that could be performed during a gluing process 700. Referring to FIG. 15, at block 702 a count variable may be initialized to zero. The count variable may be used to keep track of the number of informational items 20 that pass through the bonding unit 214 as detected by the sensor 522 (FIG. 13). For example, the first informational item 20 in each stack 10 could correspond to a count of one, the third informational item 20 in each stack 10 could correspond to a count of three, etc.

At block 704, the controller 530 waits until an informational item 20 is detected by the sensor 522. When an informational item 20 is detected, at block 706 the value of count may be incremented by one.

Where adhesive is applied to the leading face of each informational item 20, or the face that is disposed forwardly (to the right in FIGS. 13 and 13A) when the informational item 20 is oriented in a vertical position, adhesive is not applied to the first informational item 20 of each stack 10 to be formed, but is applied to every informational item 20 in the stack 10 to be formed that follows the first informational item 20. Thus, at block 708, only if the value of the count variable is greater than one, meaning the current informational item 20 is not the first one in the stack 10, the process passes to blocks 710 and 712 which cause adhesive to be applied to the current informational item 20.

At block 710, the controller 530 waits for a period of time, which may depend on the path distance between the sensor 522 and the glue applicator 524 and the speed of the upper and lower conveyor belts 472, 502, and then at block 712 the controller 530 may cause the adhesive applicator 524 to apply glue to the moving information item 20, which was detected at block 704 and which is now positioned underneath the adhesive applicator 524 due to the waiting period of block 710.

At block 714, if the current value of the count variable equals a pre-selected number of informational items 20 to be included in each stack 10, meaning that the current informational item 20 to which glue has just been applied is the last informational item 20 in the current stack 10, the process branches back to block 702 where the count variable is reset to zero since the next stack 10 is to be formed. Otherwise, the process branches back to block 704 to wait for the next informational item 20. Obviously, if adhesive is applied to the opposite face of each of the informational items 20, adhesive would be applied to each informational item 20 in the stack 10 to be formed except for the last informational item 20 in the stack 10.

Overall Operation of Outsert Forming and Bonding Machine

In the overall operation of the outsert forming and bonding machine 200 shown in FIG. 5, the printer 202 may continuously generate sheets of material having printed information disposed thereon, such as the sheet 30 shown in FIG. 2A or the sheet 70 shown in FIG. 3A. The printed sheets may then be transferred by the transfer unit 204 from the printer 202 to the accumulator 206, and then fed by the sheet feeder 208 to the first folding unit 210.

The first folding unit 210 makes one or more folds in each of the sheets, with each fold being made parallel to a first direction. The folds may correspond to the folds described above in connection with FIG. 2B; the folds may correspond to those shown in FIGS. 3A–3E; or they may correspond to some other series of folds.

The folded articles generated by the first folding unit 210 are then supplied to the second folding unit 212, which makes one or more folds in a direction perpendicular to the direction in which the folds were made by the first folding unit 210. The second folding unit 212 may make a plurality of folds like the ones described above in connection with FIGS. 2C–2E; the second folding unit 212 may make a plurality of folds like the ones described above in connection with FIGS. 3F–3I; or the second folding unit 212 may make some other combination of folds.

After being formed into informational items 20 by the second folding unit 212, the informational items 20 are automatically conveyed to the bonding unit 214 where they are bonded together into stacks 10 as described above in detail in connection with FIGS. 13, 13A, 13B, 14 and 15.

Booklet Forming and Bonding Machine

Figure 6:
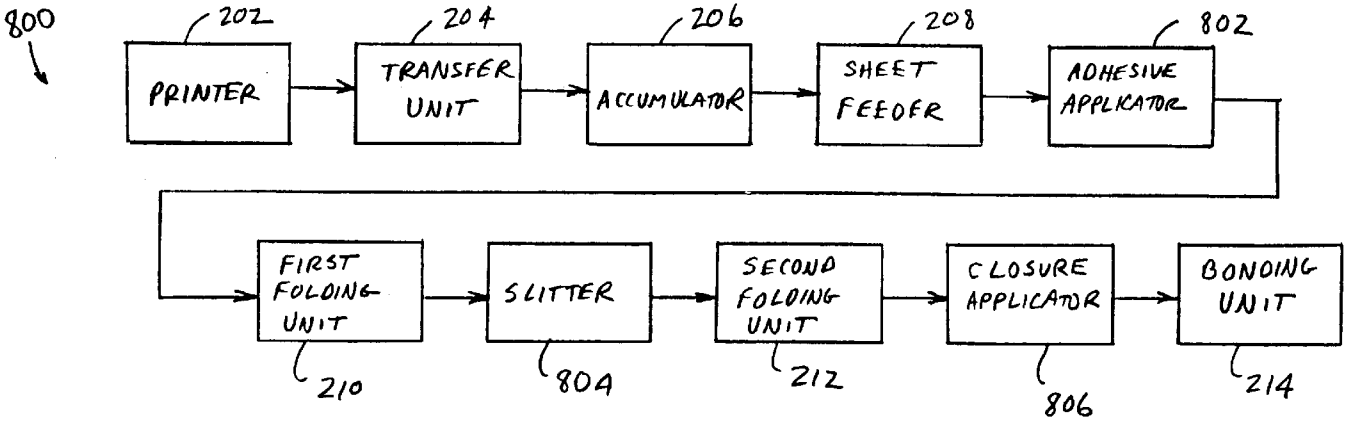
FIG. 6 is an overall block diagram of a booklet forming and bonding apparatus.

FIG. 6 is a block diagram of an embodiment of a booklet forming and bonding apparatus 800 that could be used to perform the booklet-forming methods described above. Referring to FIG. 6, the apparatus 800 may be provided with a number of the same or similar components described above in connection with the outsert-forming and bonding apparatus 200, including the printer 202, the transfer unit 204, the accumulator 206, the sheet feeder 208, the first folding unit 210, the second folding unit 212, and bonding unit 214, the operation of which may be generally the same as described above.

The booklet forming and bonding apparatus 800 may be provided with three additional components, including an adhesive applicator 802, a cutter or slitter 804 and a closure applicator 806. The adhesive applicator 802 may be used to apply a line of adhesive or plurality of adhesive portions along a line to a sheet of material before it is fed to the first folding unit 210, as described above in connection with FIGS. 4A–4E. The slitter 804 may be used to slit or cut off the folded side edges 124, 126 of the article 122, as described above in connection with FIG. 4D. The closure applicator 806 may be used to apply the closure member 140 to form a closed booklet, as described above in connection with FIG. 4F. Further details regarding the components 802, 804, 806 are disclosed in U.S. Ser. No. 09/326,821 filed in the U.S. Patent Office on Jun. 7, 1999, which is incorporated by reference herein. The particular structure of those components is not considered important to the invention, and other designs could be used.

Since each of the structures and acts described above is only exemplary and may be used in various embodiments of the invention, numerous structures and acts described above are intended to be optional. Structures and acts described above can be omitted, and other structures and acts may be substituted therefor.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of forming of outserts having product information relating to a pharmaceutical product printed thereon and bonding said outserts together, said method comprising:

(a) forming a first outsert from a first sheet of paper having information relating to a pharmaceutical product printed thereon by maling at least one fold in a first direction in said first sheet of paper and by making at least one fold in a second direction that is perpendicular to said first direction, said first outsert having a first face and a second face opposite said first face;

(b) forming a second outsert from a second sheet of paper having information relating to a pharmaceutical product printed thereon by making at least one fold in a first direction in said second sheet of paper and by making at least one fold in a second direction that is perpendicular to said first direction, said second outset having a first face and a second face opposite said first face;

(c) forming a third outsert from a third sheet of paper having information relating to a pharmaceutical product printed by making at least one fold in a first direction in said third sheet of paper and by making at least one fold in a second direction that is perpendicular to said first direction, said third outsert having a first face and a second face opposite said first face;

(d) automatically convey said first, second and third outserts to a bonding apparatus;

(e) automatically depositing an adhesive on one of said faces of said first outsert and one of said faces of said second outsert; and (f) causing said one of said faces of said fist outsert to be bonded to one of said faces of said second outsert by causing said second outsert to be pushed against said first outsert and causing one of said faces of said second outsert to be bonded to one of said faces of said third outsert to form a multiple outsert assembly having sad second outsert adhesively bonded between sad first outsert and said third outsert.

2. A method as defined in claim 1 comprising:

forming said first outsert by making a plurality of folds in each of said first and second directions;

forming said second outsert by making a plurality of folds in each of said first and second directions; and forming said third outsert by making a plurality of folds in each of said first and second directions.

3. A method of forming outserts having product information relating to a pharmaceutical product printed thereon and bonding said outserts together, said method comprising:

(a) folding a first sheet of paper having information relating to a pharmaceutical product printed thereon by making a plurality of folds in said first sheet of paper to form a first folded article, said folds in said first sheet of paper being parallel to each other and parallel to a first direction;

(b) folding said first folded article by making a plurality of folds in said first folded article to form a second folded article, said folds in said first folded article being parallel to a second direction, said second direction being perpendicular to said first direction;

(c) depositing an adhesive on a portion of said second folded article;

(d) folding said second folded article by making a fold in said second folded article to form a first outsert having a first face and a second face opposite said first face, said fold in said second folded article being parallel to said second direction and being made so that said adhesive holds said first outsert in a substantially closed position;

(e) folding a second sheet of paper having information relating to a pharmaceutical product printed thereon by making a plurality of folds in said second sheet of paper to form a third folded article, said folds in said second sheet of paper being parallel to each other and parallel to said first direction;

(f) folding said third folded article by making a plurality of folds in said third folded article to form a fourth folded article, said folds in said third folded article being parallel to said second direction;

(g) depositing an adhesive on a portion of said fourth folded article;

(h) folding said fourth folded article by making a fold in said fourth folded article to form a second outsert having a first face and a second face opposite said first face of said second outsert, said fold in said fourth folded article being parallel to said second direction and being made so that said adhesive holds said second outsert in a substantially closed position;

(i) folding a third sheet of paper having information relating to a pharmaceutical product printed thereon by making a plurality of folds in said third sheet of paper to form a fifth folded article, said folds in said third sheet of paper being parallel to each other and parallel to said first direction;

(j) folding said fifth folded article by making a plurality of folds in said fifth folded article to form a sixth folded article, said folds in said fifth folded article being parallel to said second direction;

(k) depositing an adhesive on a portion of said sixth folded article;

(l) folding said sixth folded article by making a fold in said sixth folded article to form a third outsert having a first face and a second face opposite said first face of said third outsert, said fold in said sixth folded article being parallel to said second direction and being made so that said adhesive holds said third outsert in a substantially closed position;

(m) automatically conveying said first outsert to a bonding apparatus;

(n) automatically conveying said second outsert to said bonding apparatus;

(o) automatically conveying said third outsert to said bonding apparatus;

(p) automatically depositing an adhesive on one of said faces of said first outsert;

(q) automatically depositing an adhesive on one of said faces of said second outsert;

(r) orienting said first outsert in a vertical orientation;

(s) orienting said second outsert in a vertical orientation;

(t) with said first and second outserts in said vertical orientations, pushing said second outsert against said first outsert so that said one face of said first outsert with said adhesive disposed thereon is forced against said one face of said second outsert to adhesively bond said first outsert to said second outsert;

(u) orienting said third outsert in a vertical orientation; and (v) with said second and third outserts in said vertical orientations, pushing said third outsert against said second outsert so that said one face of said second outsert with said adhesive disposed thereon is forced against said one face of said third outsert to adhesively bond said second outsert to said third outsert.

4. A method as defined in claim 3 wherein said first outsert is oriented in said vertical orientation before said second outsert is oriented in said vertical orientation.

5. A method as defined in claim 3 wherein said second outsert is pushed against said first outsert before said third outsert is oriented in said vertical orientation.

6. A method of forming outserts having product information relating to a pharmaceutical product printed thereon and bonding said outserts together, said method comprising:

(a) folding a first sheet of paper having information relating to a pharmaceutical product printed thereon by making a plurality of folds in said first sheet of paper to form a first folded article, said folds in said first sheet of paper being parallel to each other and parallel to a first direction;

(b) folding said first folded article by making a plurality of folds in said first folded article to form a second folded article, said folds in said first folded article being parallel to a second direction, said second direction being perpendicular to said first direction;

(c) depositing an adhesive on a portion of said second folded article;

(d) folding said second folded article by making a fold in said second folded article to form a first outsert having a first face and a second face opposite said first face, said fold in said second folded article being parallel to said second direction and being made so that said adhesive holds said first outsert in a substantially closed position;

(e) folding a second sheet of paper having information relating to a pharmaceutical product printed thereon by making a plurality of folds in said second sheet of paper to form a third folded article, said folds in said second sheet of paper being parallel to each other and parallel to said first direction;

(f) folding said third folded article by making a plurality of folds in said third folded article to form a fourth folded article, said folds in said third folded article being parallel to said second direction;

(g) depositing an adhesive on a portion of said fourth folded article;

(h) folding said fourth folded article by making a fold in said fourth folded article to form a second outsert having a first face and a second face opposite said first face of said second outsert, said fold in said fourth folded article being parallel to said second direction and being made so that said adhesive holds said second outsert in a substantially closed position;

(i) folding a third sheet of paper having information relating to a pharmaceutical product printed thereon by making a plurality of folds in said third sheet of paper to form a fifth folded article, said folds in said third sheet of paper being parallel to each other and parallel to said first direction;

(j) folding said fifth folded article by making a plurality of folds in said fifth folded article to form a sixth folded article, said folds in said fifth folded article being parallel to said second direction;

(k) depositing an adhesive on a portion of said sixth folded article;

(l) folding said sixth folded article by making a fold in said sixth folded article to form a third outsert having a first face and a second face opposite said first face of said third outsert, said fold in said sixth folded article being parallel to said second direction and being made so that said adhesive holds said third outsert in a substantially closed position;

(m) automatically conveying said first outsert to a bonding apparatus;

(n) automatically conveying said second outsert to said bonding apparatus;

(o) automatically conveying said third outsert to said bonding apparatus;

(p) automatically depositing an adhesive on one of said faces of said first outsert;

(q) automatically depositing an adhesive on one of said faces of said second outsert;

(r) orienting said first outsert in a first orientation;

(s) orienting said second outsert in a second orientation substantially the same as said first orientation;

(t) with said first and second outserts in said orientations, pushing said second outsert against said first outsert so that said one face of said first outsert with said adhesive disposed thereon is forced against said one face of said second outsert to adhesively bond said first outsert to said second outsert;

(u) orienting said third outsert in a third orientation substantially the same as said first orientation; and (v) with said second and third outserts in said orientations, pushing said third outsert against said second outsert so that said one face of said second outsert with said adhesive disposed thereon is forced against said one face of said third outsert to adhesively bond said second outsert to said third outsert.

7. A method as defined in claim 6 comprising:

orienting said first outsert in a vertically disposed position so that each of said faces of said first outsert are vertically disposed;

orienting said second outsert in a vertically disposed position so that each of said faces of said second outsert are vertically disposed; and pushing said second outsert against said first outsert with said first and second outserts in said vertically disposed positions so that said one face of said first outsert with said adhesive disposed thereon is forced against said one face of said second outsert.

8. A method of forming outserts having product information relating to a pharmaceutical product printed thereon and bonding said outserts together, said method comprising:

(a) folding a first sheet of paper having information relating to a pharmaceutical product printed thereon by making at least one fold in said first sheet of paper to form a first folded article, said at least one fold in said first sheet of paper being parallel to a first direction;

(b) folding said first folded article by making at least one fold in said first folded article to form a second folded article, said at least one fold in said first folded article being parallel to a second direction, said second direction being perpendicular to said first direction;

(c) depositing an adhesive on a portion of said second folded article;

(d) folding said second folded article by making a fold in said second folded article to form a first outsert having a first face and a second face opposite said first face, said fold in said second folded article being parallel to said second direction and being made so that said adhesive holds said first outsert in a substantially closed position;

(e) folding a second sheet of paper having information relating to a pharmaceutical product printed thereon by making at least one fold in said second sheet of paper to form a third folded article, said at least one fold in said second sheet of paper being parallel to said first direction;

(f) folding said third folded article by making at least one fold in said third folded article to form a fourth folded article, said at least one fold in said third folded article being parallel to said second direction;

(g) depositing an adhesive on a portion of said fourth folded article;

(h) folding said fourth folded article by making a fold in said fourth folded article to form a second outsert having a first face and a second face opposite said first face of said second outsert, said fold in said fourth folded article being parallel to said second direction and being made so that said adhesive holds said second outsert in a substantially closed position;

(i) folding a third sheet of paper having information relating to a pharmaceutical product printed thereon by making at least one fold in said third sheet of paper to form a fifth folded article, said at least one fold in said third sheet of paper being parallel to said first direction;

(j) folding said fifth folded article by making at least one fold in said fifth folded article to form a sixth folded article, said at least one fold in said fifth folded article being parallel to said second direction;

(k) depositing an adhesive on a portion of said sixth folded article;

(l) folding said sixth folded article by making a fold in said sixth folded article to form a third outsert having a first face and a second face opposite said first face of said third outsert, said fold in said sixth folded article being parallel to said second direction and being made so that said adhesive holds said third outsert in a substantially closed position;

(m) automatically conveying said first outsert to a bonding apparatus;

(n) automatically conveying said second outsert to said bonding apparatus;

(o) automatically conveying said third outsert to said bonding apparatus;

(p) automatically depositing an adhesive on one of said faces of said first outsert;

(q) automatically depositing an adhesive on one of said faces of said second outsert;

(r) orienting said first outsert in a first orientation;

(s) orienting said second outsert in a second orientation substantially the same as said first orientation;

(t) with said first and second outserts in said orientations, pushing said second outsert against said first outsert so that said one face of said first outsert with said adhesive disposed thereon is forced against said one face of said second outsert to adhesively bond said first outsert to said second outsert;

(u) orienting said third outsert in a third orientation substantially the same as said first orientation; and (v) with said second and third outserts in said orientations, pushing said third outsert against said second outsert so that said one face of said second outsert with said adhesive disposed thereon is forced against said one face of said third outsert to adhesively bond said second outsert to said third outsert.

9. A method as defined in claim 8 comprising:

orienting said first outsert in a vertically disposed position so that each of said faces of said first outsert are vertically disposed;

orienting said second outsert in a vertically disposed position so that each of said faces of said second outsert are vertically disposed; and pushing said second outsert against said first outsert with said first and second outserts in said vertically disposed positions so that said one face of said first outsert with said adhesive disposed thereon is forced against said one face of said second outsert.

10. A method as defined in claim 8 wherein said first outsert is oriented in said first orientation before said second outsert is oriented in said second orientation.

11. A method as defined in claim 8 wherein said second outsert is pushed against said first outsert before said third outsert is oriented in said third orientation.

12. A method of forming outserts having product information relating to a pharmaceutical product printed thereon and bonding said outserts together, said method comprising:

(a) forming a first outsert from a first sheet of paper having information relating to a pharmaceutical product printed thereon by making a plurality of folds in a first direction in said first sheet of paper and by making a plurality of folds in a second direction that is perpendicular to said first direction, said first outsert having a first face and a second face opposite said first face;

(b) forming a second outsert from a second sheet of paper having information relating to a pharmaceutical product printed thereon by making a plurality of folds in a first direction in said second sheet of paper and by making a plurality of folds in a second direction that is perpendicular to said first direction, said second outsert having a first face and a second face opposite said first face;

(c) forming a third outsert from a third sheet of paper having information relating to a pharmaceutical product printed thereon by making a plurality of folds in a first direction in said third sheet of paper and by making a plurality of folds in a second direction that is perpendicular to said first direction, said third outsert having a first face and a second face opposite said first face;

(d) automatically conveying said first outsert to a bonding apparatus;

(e) automatically conveying said second outsert to said bonding apparatus;

(f) automatically conveying said third outsert to said bonding apparatus;

(g) automatically depositing an adhesive on one of said faces of said first outsert;

(h) automatically depositing an adhesive on one of said faces of said second outsert;

(i) orienting said first outsert in a first orientation;

(j) orienting said second outsert in a second orientation substantially the same as said first orientation;

(k) with said first and second outserts in said orientations, pushing said second outsert against said first outsert so that said one face of said first outsert with said adhesive disposed thereon is forced against said one face of said second outsert to adhesively bond said first outsert to said second outsert;

(l) orienting said third outsert in a third orientation substantially the same as said first orientation; and (m) with said second and third outserts in said orientations, pushing said third outsert against said second outsert so that said one face of said second outsert with said adhesive disposed thereon is forced against said one face of said third outsert to adhesively bond said second outsert to said third outsert.

13. A method as defined in claim 12 comprising:

orienting said first outsert in a vertically disposed position so that each of said faces of said first outsert are vertically disposed;

orienting said second outsert in a vertically disposed position so that each of said faces of said second outsert are vertically disposed; and pushing said second outsert against said first outsert with said first and second outserts in said vertically disposed positions so that said one face of said first outsert with said adhesive disposed thereon is forced against said one face of said second outsert.

14. A method as defined in claim 12 wherein said first outsert is oriented in said first orientation before said second outsert is oriented in said second orientation.

15. A method as defined in claim 12 wherein said second outsert is pushed against said first outsert before said third outsert is oriented in said third orientation.

16. A method of forming outserts having product information relating to a pharmaceutical product printed thereon and bonding said outserts together, said method comprising:

(a) forming a first outsert from a first sheet of paper having information relating to a pharmaceutical product printed thereon by making at least one fold in a first direction in said first sheet of paper and by making at least one fold in a second direction that is perpendicular to said first direction, said first outsert having a first face and a second face opposite said first face;

(b) forming a second outsert from a second sheet of paper having information relating to a pharmaceutical product printed thereon by making at least one fold in a first direction in said second sheet of paper and by making at least one fold in a second direction that is perpendicular to said first direction, said second outsert having a first face and a second face opposite said first face;

(c) forming a third outsert from a third sheet of paper having information relating to a pharmaceutical product printed thereon by making at least one fold in a first direction in said third sheet of paper and by making at least one fold in a second direction that is perpendicular to said first direction, said third outsert having a first face and a second face opposite said first face;

(d) automatically conveying said first, second and third outserts to a bonding apparatus;

(e) automatically depositing an adhesive on one of said faces of said first outsert and one of said faces of said second outsert;

(f) orienting said first outsert in a vertical orientation;

(g) orienting said second outsert in a vertical orientation;

(h) with said first and second outserts in said vertical orientations, pushing said second outsert against said first outsert so that said one face of said first outsert with said adhesive disposed thereon is forced against said one face of said second outsert to adhesively bond said first outsert to said second outsert;

(i) orienting said third outsert in a vertical orientation; and (j) with said second and third outserts in said vertical orientations, pushing said third outsert against said second outsert so that said one face of said second outsert with said adhesive disposed thereon is forced against said one face of said third outsert to adhesively bond said second outsert to said third outsert.

17. A method as defined in claim 16 wherein said first outsert is oriented in said vertical orientation before said second outsert is oriented in said vertical orientation.

18. A method as defined in claim 16 wherein said second outsert is pushed against said first outsert before said third outsert is oriented in said vertical orientation.

19. A method as defined in claim 16 comprising:

forming said first outsert by making a plurality of folds in each of said first and second directions;

forming said second outsert by making a plurality of folds in each of said first and second directions; and forming said third outsert by making a plurality of folds in each of said first and second directions.

* * * * *